US007956830B2

(12) United States Patent
Chen et al.

(10) Patent No.: US 7,956,830 B2
(45) Date of Patent: Jun. 7, 2011

(54) ORGANIC LIGHT-EMITTING DIODE (OLED) PANEL AND DRIVING METHOD WITH COMPENSATION VOLTAGE THEREOF

(75) Inventors: Yung-Chih Chen, Hsinchu (TW); Chih-Lung Lin, Hsinchu (TW); Yuan-Chun Wu, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 1061 days.

(21) Appl. No.: 11/739,777

(22) Filed: Apr. 25, 2007

(65) Prior Publication Data

US 2008/0018568 A1 Jan. 24, 2008

(30) Foreign Application Priority Data

Jul. 24, 2006 (TW) ..... 95126896 A

(51) Int. Cl.
*G09G 3/32* (2006.01)
*G09G 3/30* (2006.01)

(52) U.S. Cl. ..... 345/82; 345/78

(58) Field of Classification Search ..... 345/76–84, 345/204; 315/169.1–169.3
See application file for complete search history.

(56) References Cited

U.S. PATENT DOCUMENTS 6,774,577 B2 * 8/2004 Choi ..... 315/169.3
7,358,938 B2 * 4/2008 Kim ..... 345/77
2004/0051685 A1 * 3/2004 Chung et al. ..... 345/82
2005/0110730 A1 * 5/2005 Kim et al. ..... 345/82
2005/0259051 A1 * 11/2005 Lee et al. ..... 345/76
2005/0269959 A1 * 12/2005 Uchino et al. ..... 315/169.3
2005/0280614 A1 * 12/2005 Goh ..... 345/76
2006/0028408 A1 * 2/2006 Kim ..... 345/76
2006/0038501 A1 * 2/2006 Koyama et al. ..... 315/169.3
2006/0043375 A1 3/2006 Takasugi et al.
2006/0061560 A1 * 3/2006 Yamashita et al. ..... 345/204
2006/0066532 A1 3/2006 Jeong
2006/0108937 A1 * 5/2006 Kim ..... 315/169.3
2006/0170628 A1 * 8/2006 Yamashita et al. ..... 345/76
2007/0080908 A1 * 4/2007 Nathan et al. ..... 345/77
2007/0115225 A1 * 5/2007 Uchino et al. ..... 345/76

FOREIGN PATENT DOCUMENTS

KR 1020040008922 A 1/2004
KR 1020050080812 A 12/2006

OTHER PUBLICATIONS

English translation of abstract of KK 1020050080812.
English translation of abstract of KR 1020040008922.

* cited by examiner

*Primary Examiner* — Sumati Lefkowitz
*Assistant Examiner* — Rodney Amadiz
(74) *Attorney, Agent, or Firm* — Thomas, Kayden, Horstemeyer & Risley, LLP

(57) ABSTRACT

An organic light-emitting diode (OLED) panel and driving method thereof is provided. The OLED panel includes a plurality of data lines, scan lines, pixels, sampling voltage lines and compensation voltage lines. The sampling voltage line transmits a compensation voltage in response to compensation signals from the data lines, threshold voltages of driving transistors and organic light emitting diodes in the pixels connected to the same scan line. The corresponding compensation voltage line adjusts data signals transmitted into the pixels connected to the same scan line in response to the compensation voltage.

30 Claims, 33 Drawing Sheets

ORGANIC LIGHT-EMITTING DIODE (OLED) PANEL AND DRIVING METHOD WITH COMPENSATION VOLTAGE THEREOF

CROSS-REFERENCES TO RELATED APPLICATIONS

This non-provisional application claims priority under 35 U.S.C. §119(a) on Patent Application No. 095126896 filed in Taiwan, R.O.C. on Jul. 24, 2006 the entire contents of which are incorporated herein by reference.

FIELD OF INVENTION

The present invention relates to a panel, and more particularly, to an organic light-emitting diode (OLED) panel and a driving method thereof.

BACKGROUND

In an active-matrix OLED panel, an image is formed by a large quantity of pixels arranged in a matrix. The brightness of each pixel is controlled by the data signal. In conventional arts, each pixel has a bias switch, a storage capacitor, a driving transistor and a light-emitting diode. When a scan line supplies a scan signal to a control terminal of the bias switch, the bias switch is turned on and the data line inputs a data signal via the bias switch to charge the storage capacitor. Then, the scan line stops supplying the scan signal so that the bias switch is turned-off. Therefore, the driving transistor is electrically separated from the data line. Hence, the gate voltage of the driving transistor stably maintains so that the data signal transmitted from the data line can be fed into the storage capacitor during a period of time. A driving current flowing through the light-emitting diode is determined by the voltage difference between the gate and the source of the driving transistor and the threshold voltage of the driving transistor. The light-emitting diode emits light according to the driving current.

One of the factors that affect the current flowing through the light emitting diode is the threshold voltage, and the threshold voltage usually varies because of the manufacturing variation. Besides the manufacturing variation, each of the light emitting diode decays in different rates according to the material properties. Therefore, when inputting same voltage signals, it may generate different driving currents to result in irregular brightness of the panel.

To overcome this problem, in the prior arts, there is the compensation circuit in the pixel to compensate the threshold voltage. Various compensation circuits have been applied to solve the above-mentioned problem, such as the disclosure in Taiwanese patent publication number I237913 and in U.S. Pat. No. 6,859,103. In these prior arts, one or more transistors, one or more current sources and/or changing the circuit design of the original components are added into the circuit design of the conventional pixel to compensate the threshold voltage. However, there are still some problems. By doing so it will have to increase the number of the components, and therefore make the design of the circuit of the pixel be more complicated, to reduce the aperture ratio and then to cause insufficient brightness of the panel. Besides, it will need to apply more complex control signals in the conventional pixel, such as to cause more difficulty in the quality control.

SUMMARY

The present invention overcomes the problems of the prior art by providing an organic light-emitting diode (OLED) panel and driving method thereof to solve various problems and limitations existing in the prior art.

It is, therefore, an object of the present invention to provide an OLED panel comprising a plurality of data lines, a plurality of scan lines, a plurality of pixels, a plurality of sampling voltage lines, and a plurality of compensation voltage lines.

The pixels are defined by two neighboring data lines and two neighboring scan lines crossing two neighboring data lines, and the pixels which are connected to the same scan line are connected to the same sampling voltage line and the same compensation voltage line which correspond to each other.

The sampling voltage line can generate a compensation voltage in response to the compensation signals transmitted through the data lines and threshold voltages of the driving transistors and the organic light emitting diodes of the pixels connected thereto. The corresponding compensation voltage line can adjust data signals, which are transmitted into the pixels connected to the same scan line, in response to the compensation voltage.

According to an embodiment of the present invention, the OLED panel further comprises several compensation circuits. Each compensation circuit comprises a compensation capacitor, a sampling switch, a first switch and a second switch.

The sampling switch is connected to the first end of the compensation capacitor and the sampling voltage line, the first switch is connected between the first end of the compensation capacitor and one of a ground and a voltage source, and the second end of the compensation capacitor is connected to the compensation voltage line.

Moreover, a reset switch can be bridge connected with the compensation capacitor, to reset the compensation capacitor.

According to an embodiment of the present invention, the OLED panel further comprises a switch controller. The switch controller can generate control signals according to the types of the reset switches, the sampling switches, the first switches and the second switches, to control the compensation circuits.

Further, the control signals can be based on the scan signal to be generated.

The driving method of the OLED panel, which has several pixels with each pixel being defined by two neighboring data lines and two neighboring scan lines crossing the two neighboring data lines and comprising an organic light emitting diode, a driving transistor and a bias switch, comprises the following steps. First, a compensation signal is transmitted from the data line via the bias switch, to drive the driving transistor, such that current flows through the organic light emitting diode. A compensation voltage is generated in response to threshold voltages of the driving transistors and the organic light emitting diodes in the pixels connected to the same scan line. A data signal is transmitted through the data line via the bias switch. Each of the data signals, transmitted into the pixels which are connected to the same scan line, is adjusted in response to the compensation voltage. And, the driving transistor is drove in response to the adjusted data signal, to drive the organic light emitting diode.

The driving method of the OLED panel, which has several pixels with each pixel being defined by two neighboring data lines and two neighboring scan lines crossing the two neighboring data lines and comprising an organic light emitting diode, a driving transistor and a bias switch, comprises the following steps. First, a compensation signal is transmitted from the data line via the bias switch, to drive the driving transistor, such that current flows through the organic light emitting diode. A compensation voltage is generated in the first end of an external compensation capacitor in response to threshold voltages of the driving transistors and the organic light emitting diodes in the pixels connected to the same scan lines. A data signal is transmitted from the data line via the bias switch. Each of the data signals, which are transmitted into the pixels connected to the same scan lines, is adjusted via a second end of the external compensation capacitor in response to the compensation voltage. And, the driving transistor is drove in response to the adjusted data signal, to drive the organic light emitting diode.

The present invention will be apparent in its objects, features and advantages after reading the detailed description of the preferred embodiment thereof with reference to the accompanying drawings.

BRIEF DESCRIPTION OF THE DRAWINGS

The following detailed description of the embodiments of the present invention can be best understood when read in conjunction with the following drawings, where like structure is indicated with like reference numerals and in which.

DETAILED DESCRIPTION

Figure 1:
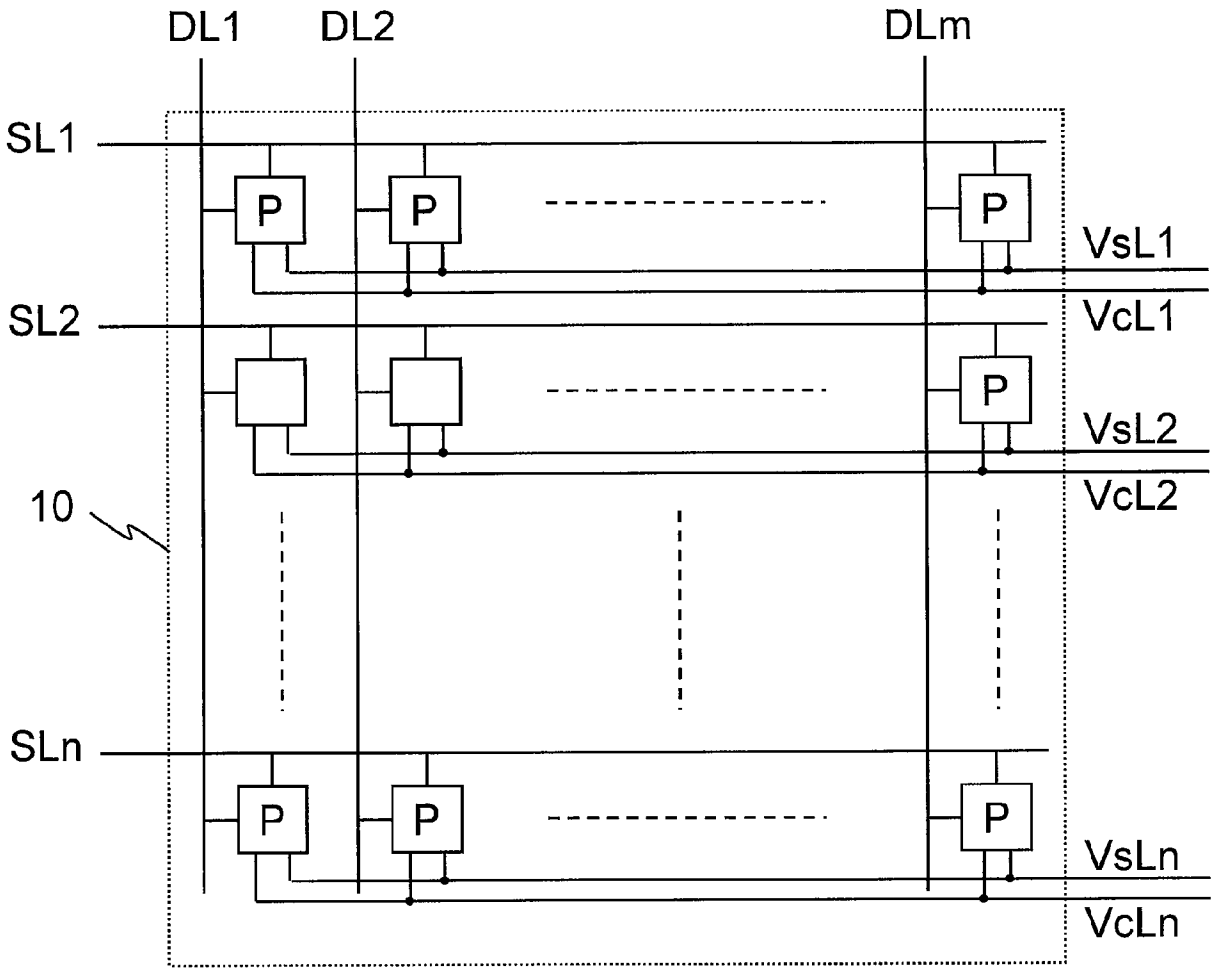
FIG. 1 is a schematic view of an OLED panel according to the first embodiment of the invention.

FIG. 1 shows an OLED panel according to the invention. The OLED panel 10 comprises several data lines DL1 to DLm, several scan lines SL1 to SLn, several pixel P, several sampling voltage lines VsL1 to VsLn and several compensation voltage lines VcL1 to VcLn.

The pixels P are defined by crossing the data lines DL1 to DLm and the scan lines SL1 to SLn in isolation. That is, each pixel P is defined by two neighboring data lines and two neighboring scan lines crossing two neighboring data lines.

Each of the sampling voltage lines VsL1 to VsLn is connected to a line unit of the pixels P, i.e. it is electrically connected to the pixels connecting to the same scan line. The compensation voltage lines VcL1 to VcLn respectively correspond to the sampling voltage lines VsL1 to VsLn, and are connected to the pixels P the same as the ones to which the corresponding sampling voltage lines VsL1 to VsLn are connected.

In other words, the pixels P connected to the same scan line are connected to the sampling voltage line and the compensation voltage line which correspond to each other.

Each of the data lines DL1 to DLm transmits a compensation signal, and the scan line SLn transmits a scan signal, such that small current flows through the organic light emitting diode (not shown) in the pixels P connected to the same scan line SLn. Then, the sampling voltage line VsLn generates a compensation voltage in response to the compensation signals and threshold voltages of the driving transistors (not shown) and the organic light emitting diodes (not shown) in the pixels P connected thereto. Therefore, the corresponding compensation voltage line VcL1 to VcLn adjusts the data signals transmitted from the data lines into the pixels P connected thereto in response to the compensation voltage.

Figure 2:
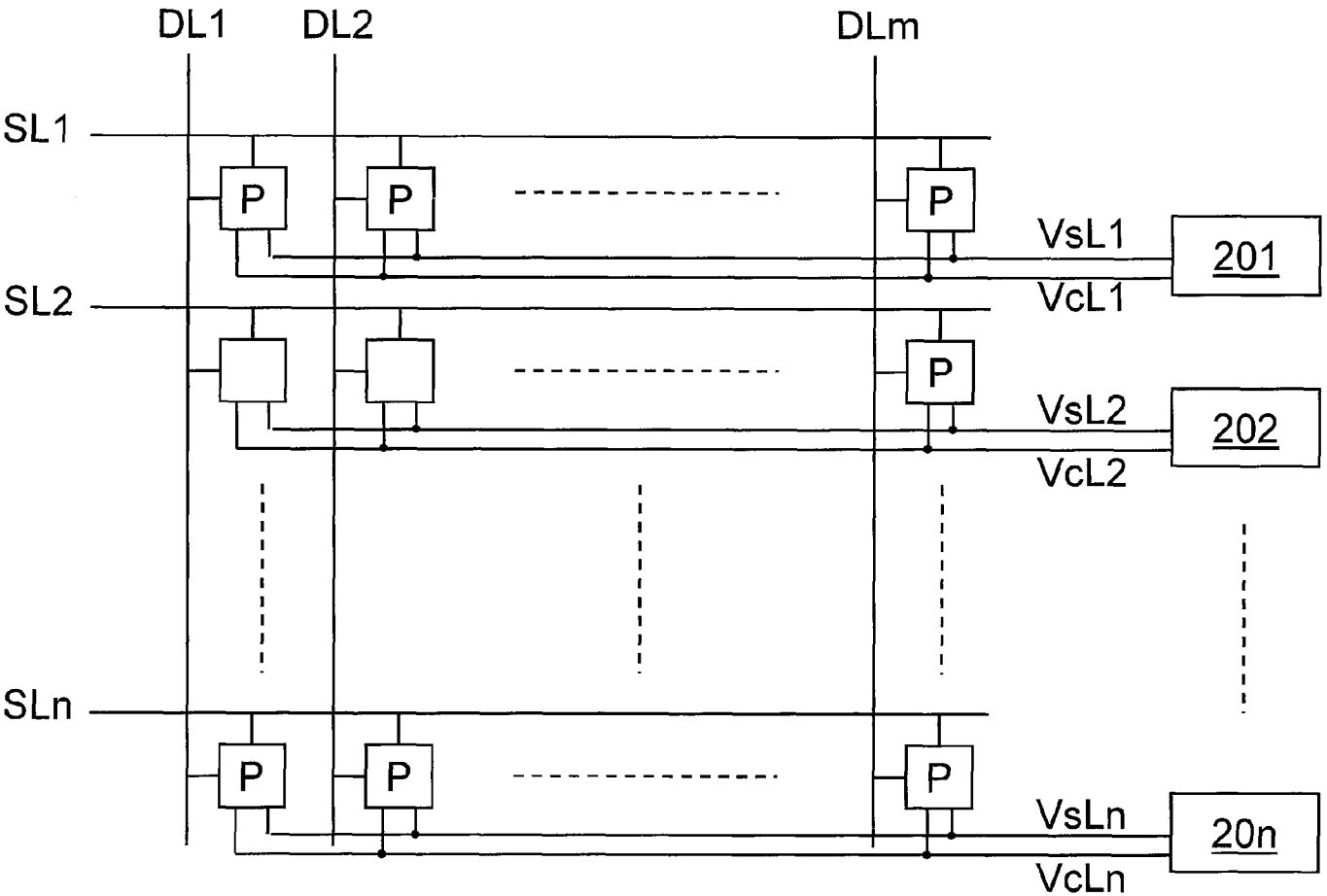
FIG. 2 is a schematic view of the OLED panel according to the second embodiment of the invention.

Refer to FIG. 2, them, which are connected to the same line unit of the pixels P, of the sampling voltage lines VsL1 to VsLn and the compensation voltage lines VcL1 to VcLn are connected one of compensation circuits 201 to 20*n*, i.e. the compensation circuit 20*n* is connected to the sampling voltage line VsLn and the corresponding compensation voltage line VcLn. In other words, the compensation circuit compensates the threshold voltages of the transistors in the same line unit of the pixels P, i.e. the pixels P connected to the same scan line. In the actual fabrication, the compensation circuits can be designed in non-illuminated region of the panel or be an element outside the panel.

Figure 3:
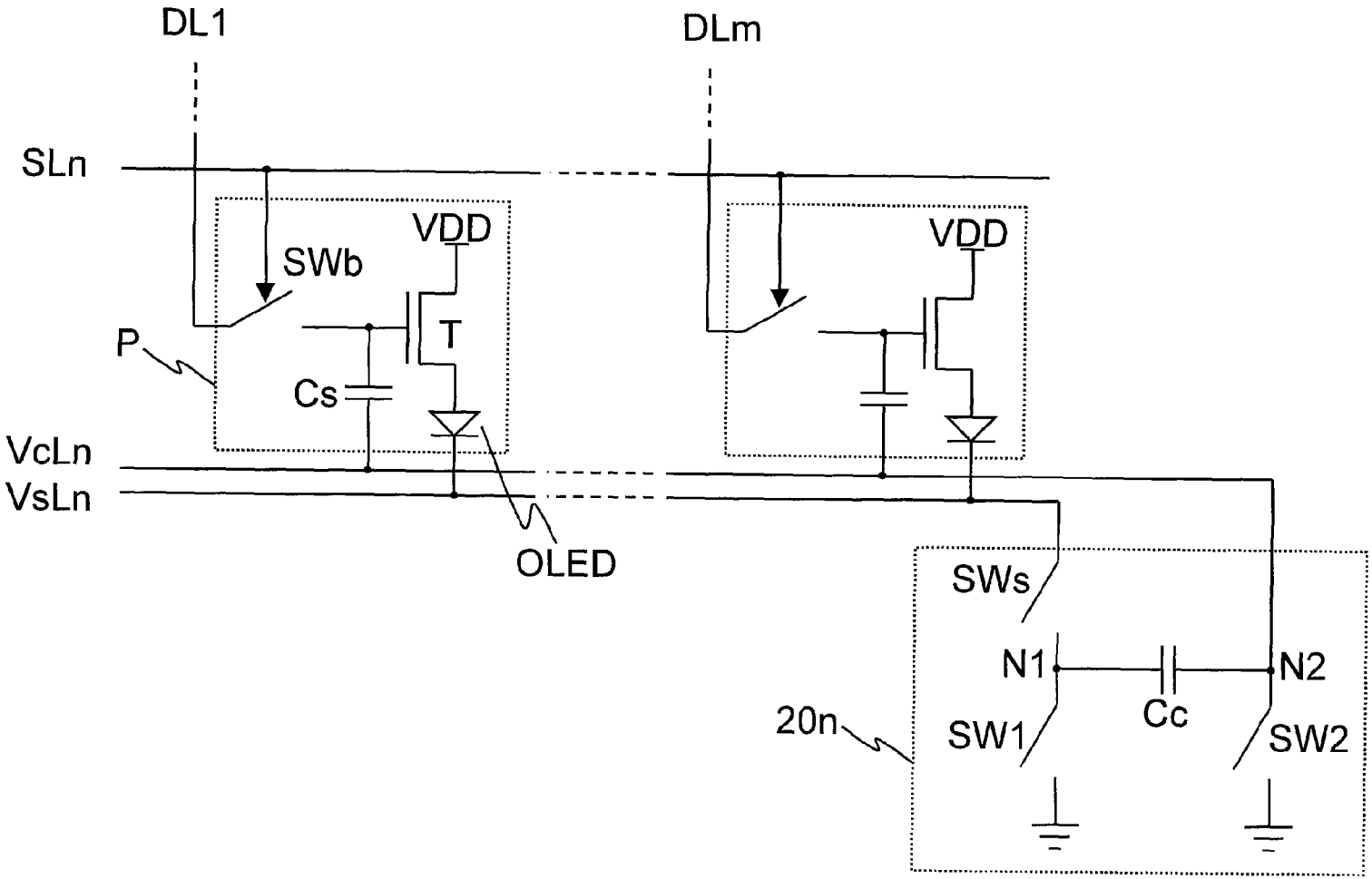
FIG. 3 is a schematic view illustrating first embodiment of partial circuit architecture of the OLED panel according to the invention.

Referring to FIG. 3, each of the pixels P includes a bias switch SWb, a storage capacitor Cs, a driving transistor T and an organic light emitting unit diode OLED. The gate of the driving transistor T is connected to the bias switch SWb, and the drain and source of the driving transistor T are respectively connected to a voltage source VDD and the organic light emitting diode OLED. The control terminal of the bias switch SWb is connected to the scan line, to electrically connect the data line and the control terminal of the driving transistor T, which are connected thereto, in response to the scan signal from the scan line connected thereto. Then, the driving transistor T electrically connects the voltage source VDD and the organic light emitting diode OLED in response to the signal from the bias switch SWb, to control the current passing through the organic light emitting diode OLED. The storage capacitor Cs is connected between the compensation voltage line and the control terminal of the driving transistor T.

Each of the compensation circuits 201 to 20*n* includes a compensation capacitor Cc, a sampling switch SWs, a first switch SW1 and a second switch SW2. The compensation circuit compensates the threshold voltages of the transistors in the line unit of the pixels by an external compensation capacitor Cc, i.e. utilizing the external compensation capacitor Cc to compensate the pixels P connected to the same scan line.

As an example of the n-th scan line SLn, in the compensation circuits 20*n*, the sampling switch SWs is connected between the sampling voltage lines VsLn and the first end N1 of the compensation capacitor Cc, the first switch SW1 is connected between the first end N1 of the compensation capacitor Cc and the ground, the second switch SW2 is connected between the second end N2 of the compensation capacitor Cc and the ground, and the second end N2 of the compensation capacitor Cc is connected to the compensation voltage lines VcLn.

Figure 4A:
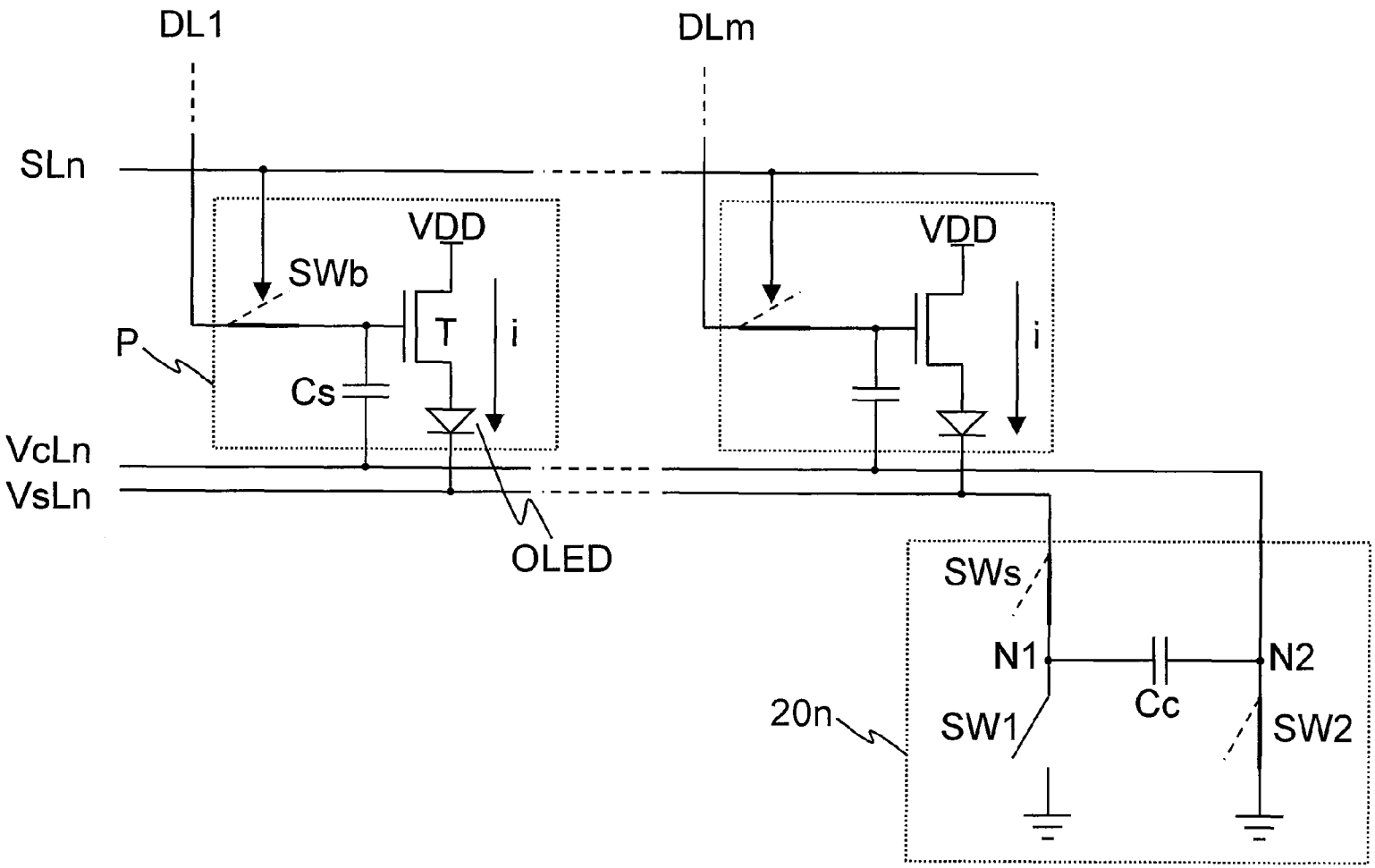
FIGS. 4A to 4D are illustrating an operation of a compensation circuit shown in FIG. 3.

Referring to FIG. 4A, when the data lines DL1 to DLm respectively transmit the compensation signals (Vcomp) into the pixels P in the n-th horizontal line, i.e. the pixels P connected to the same scan line SLn, the sampling switch SWs and the second switch SW2 of the compensation circuits 20*n* are on and the first switch SW1 of the compensation circuits 20*n* is off. At this time, the voltage level of the compensation voltage lines VcLn is grounded, i.e. 0 V, a small current i flows through the driving transistor T and the organic light emitting diode OLED to charge the compensation capacitor Cc, such that the voltage of the first end N1 (Vc_N1) rises into that which is left by the sum of the threshold voltages (Vth_T, Vth_LU) of the driving transistor T and the organic light emitting diode OLED subtracted from the voltage of the compensation signal (Vcomp), i.e. Vc_N1=Vcomp−Vth_T−Vth_LU.

Figure 4B:
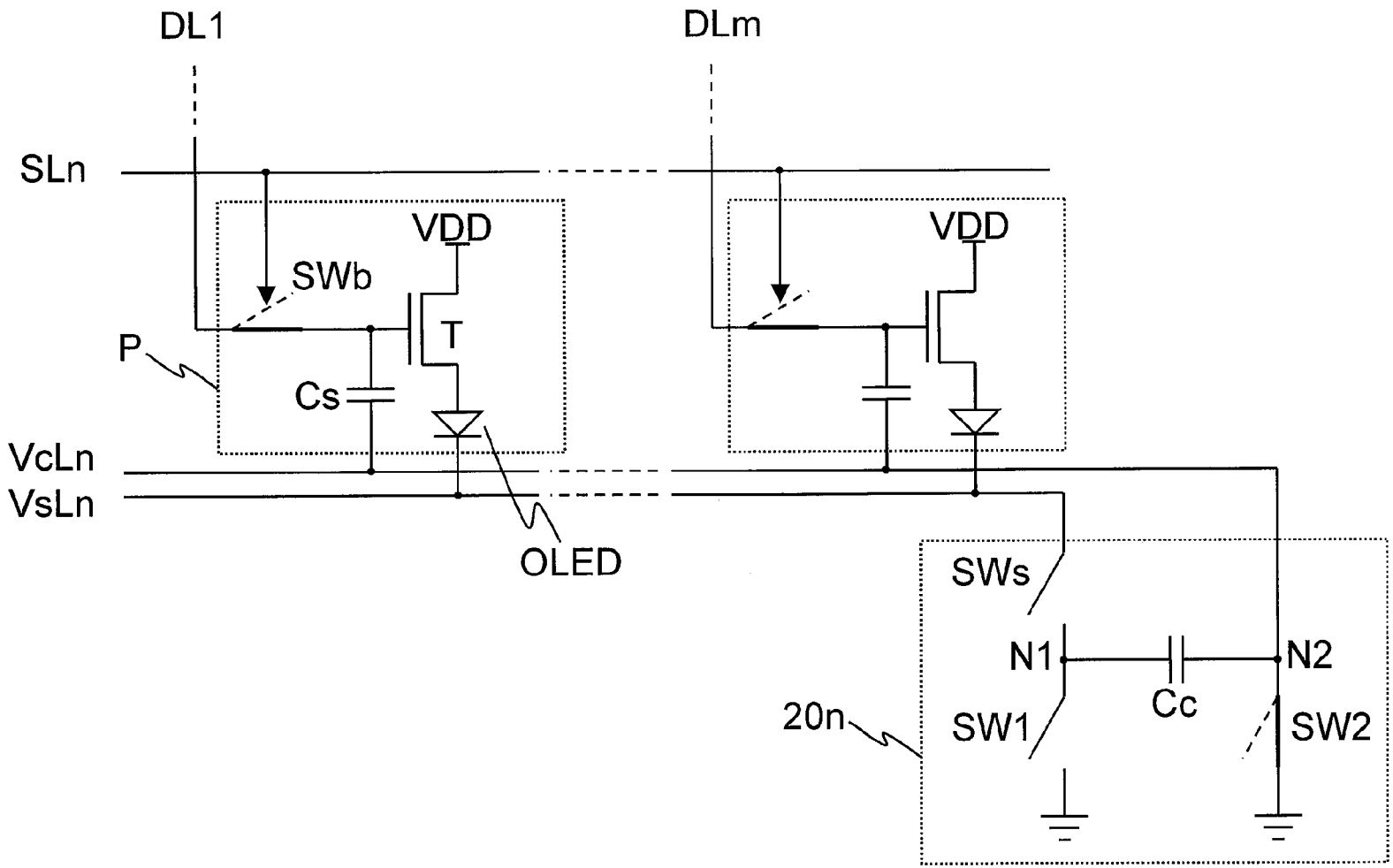

Referring to FIG. 4B, when the data lines DL1 to DLm respectively transmit the data signals (Vdata) into the pixels P connected to the same scan line SLn, the second switch SW2 of the compensation circuits 20*n* is on and the sampling switch SWs and the first switch SW1 of the compensation circuits 20*n* are off, to store the data signals into the storage capacitors Cs. At this time, the voltage of the first end N1 (Vc_N1) keeps that which is Vcomp−Vth_T−Vth_LU.

Figure 4C:
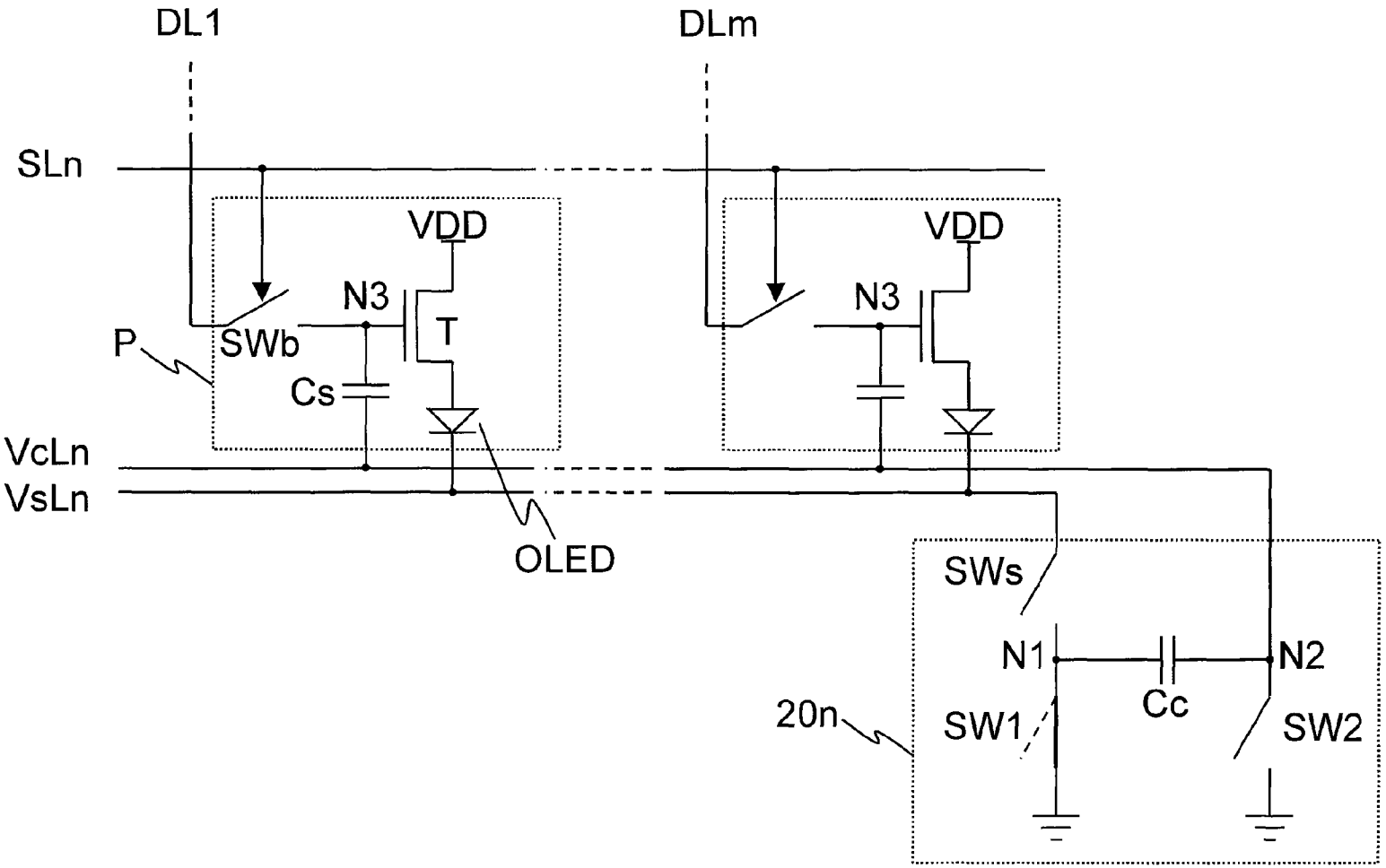

Referring to FIG. 4C, before the organic light emitting diodes OLED of the pixels connected to the same scan line SLn is on, the first switch SW1 of the compensation circuits 20*n* is on and the sampling switch SWs and the second switch SW2 of the compensation circuits 20*n* are off. The storage capacitor Cs in the pixels is connected to the compensation capacitor Cc of the external compensation circuit 20*n* in series, and the polarity of the compensation capacitor Cc is reverse after the series connection, such that the voltage of the compensation voltage lines VcLn is that which is left by Vth_T+Vth_LU−Vcomp, i.e. the voltage of the compensation signal subtracted from the sum of the threshold voltages of the driving transistor T and the organic light emitting diodes OLED. The voltage stored in the storage capacitor Cs is the voltage of the data signal (Vdata). The voltage of the node N3 is that which is left by the voltage of the compensation signal (Vcomp) subtracted from the sum of threshold voltages of the driving transistor T and the organic light emitting diodes OLED (Vth_T+Vth_OLED) and the voltage of the data signal (Vdata), i.e. Vth_T+Vth_OLED−Vcomp+Vdata.

Figure 4D:
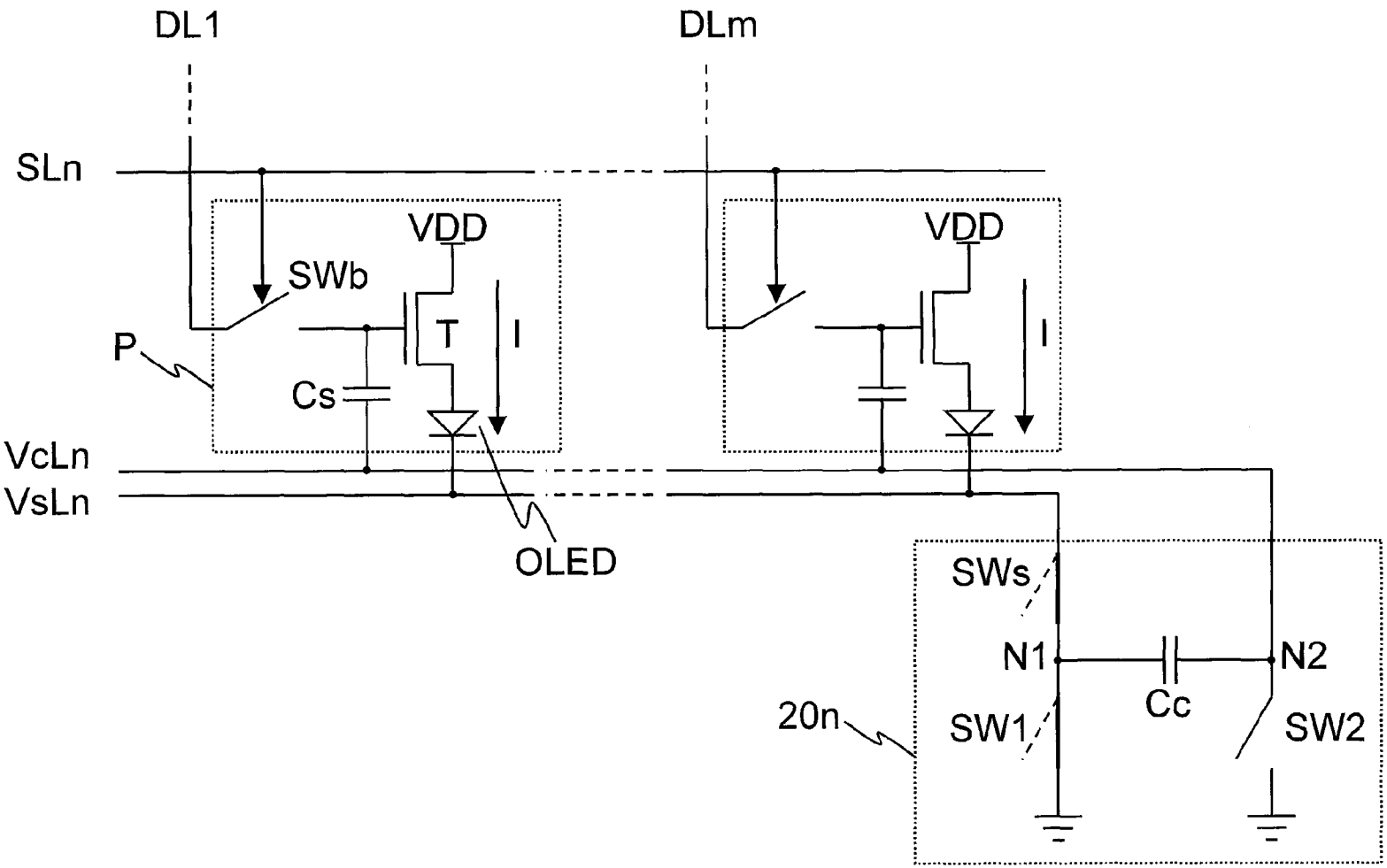

Referring to FIG. 4D, when the organic light emitting diodes OLED of the pixels connected to the same scan line SLn is on, the second switch SW2 of the compensation circuits 20*n* is on and the sampling switch SWs and the first switch SW1 of the compensation circuits 20*n* are off. A driving current I passing through the organic light emitting diode OLED is as below formula: $I=k/2(Vgs-Vth)^2=k/2(Vdata-Vcomp)^2$, wherein k is a constant, Vgs represents the bias voltage between the gate and source of the driving transistor T, i.e. the voltage of the compensation voltage line VcLn, and Vth represents the sum of the threshold voltages of the driving transistor T and the organic light emitting diode OLED (Vth_T+Vthe_OLED). Therefore, the amount of the current of the organic light emitting diode OLED can be not influenced by the threshold voltages of the driving transistor T and the organic light emitting diode OLED.

Figure 5:
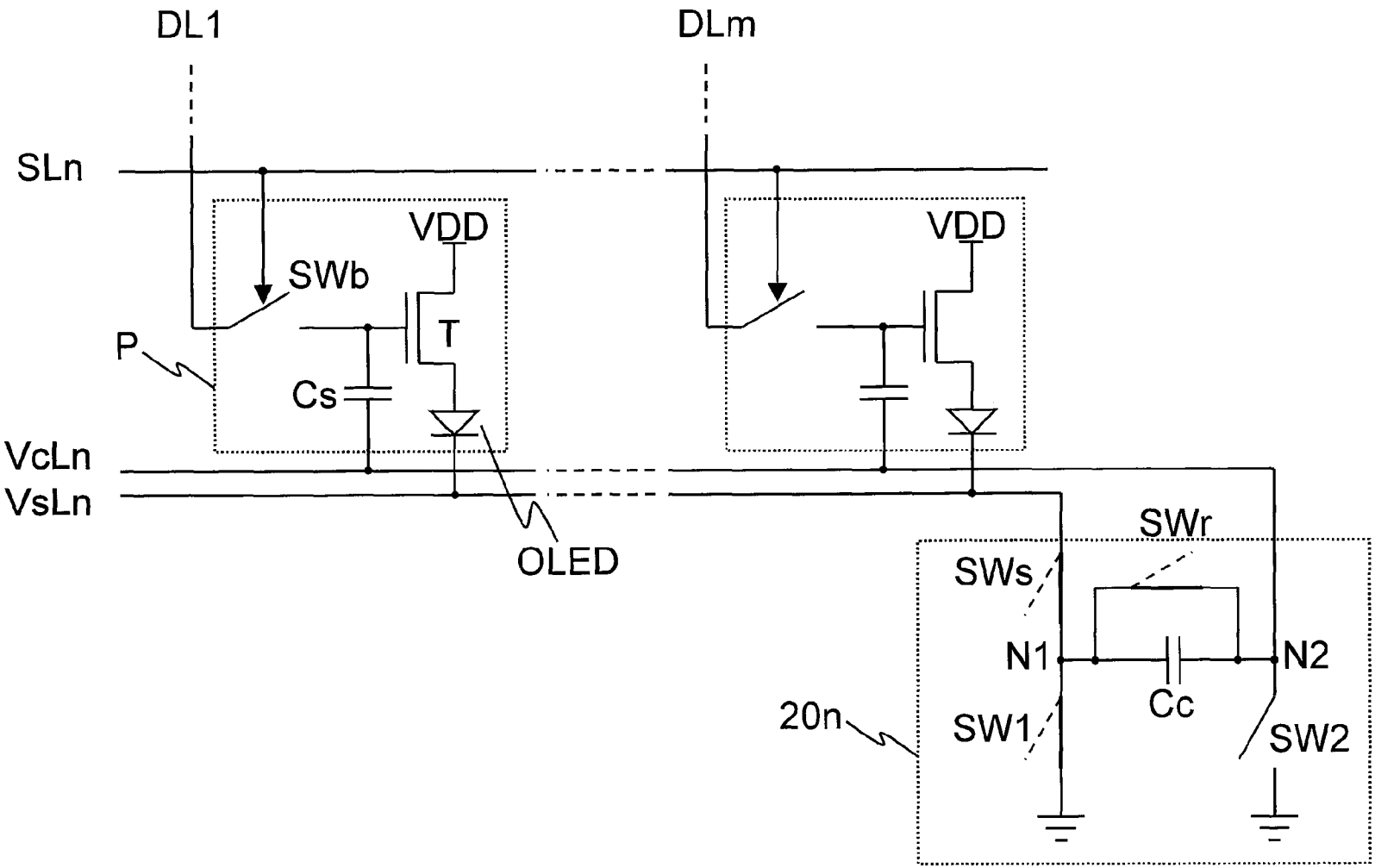
FIG. 5 is a schematic view illustrating second embodiment of the partial circuit architecture of the OLED panel according to the invention.

Referring to FIG. 5, a reset switch SWr can be bridge connected with the compensation capacitor Cc, i.e. the reset switch SWr can be connected to the first end N1 and the second end N2, to reset the compensation capacitor Cc. As an example of the n-th scan line SLn, when pre-stage of the scan line, i.e. SL(n-1) (not shown) works, the sampling switch SWs, the first switch SW1 and the reset switch SWr of the compensation circuits 20*n* is on and the second switch SW2 of the compensation circuits 20*n* is off, to substantially completely discharge the compensation capacitor Cc.

Figure 6:
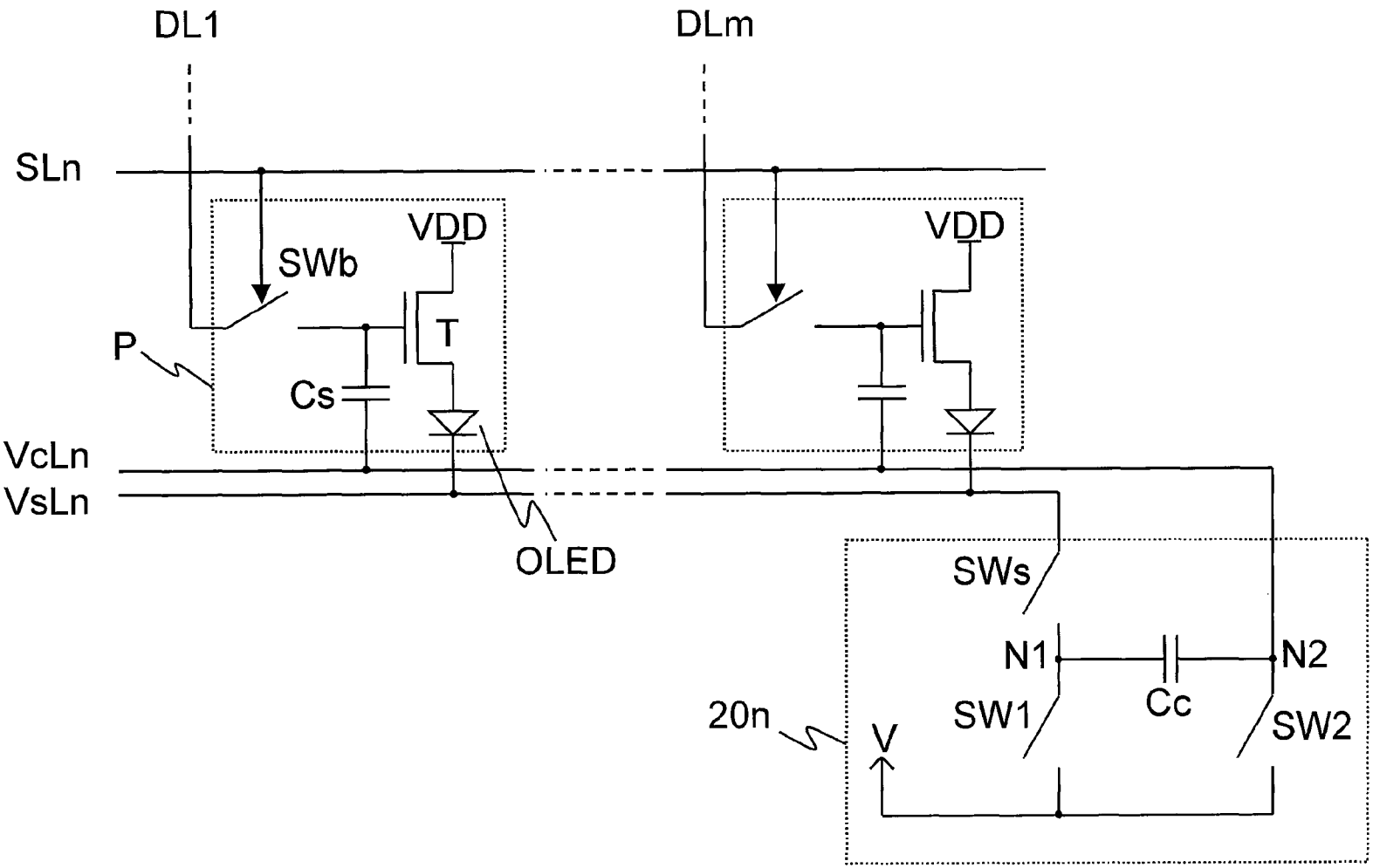
FIG. 6 is a schematic view illustrating third embodiment of the partial circuit architecture of the OLED panel according to the invention.
Figure 7:
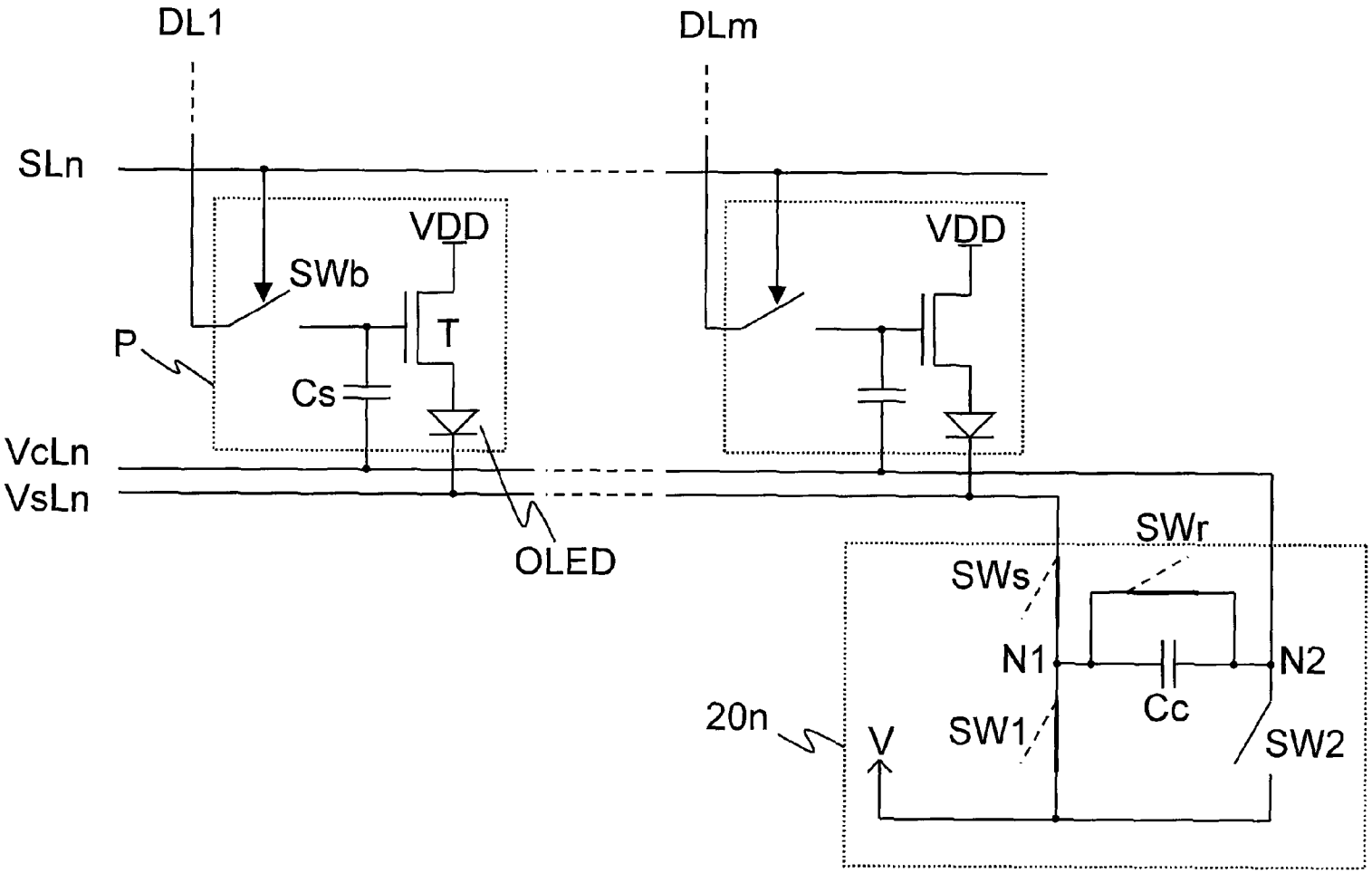
FIG. 7 is a schematic view illustrating fourth embodiment of the partial circuit architecture of the OLED panel according to the invention.
Figure 8A:
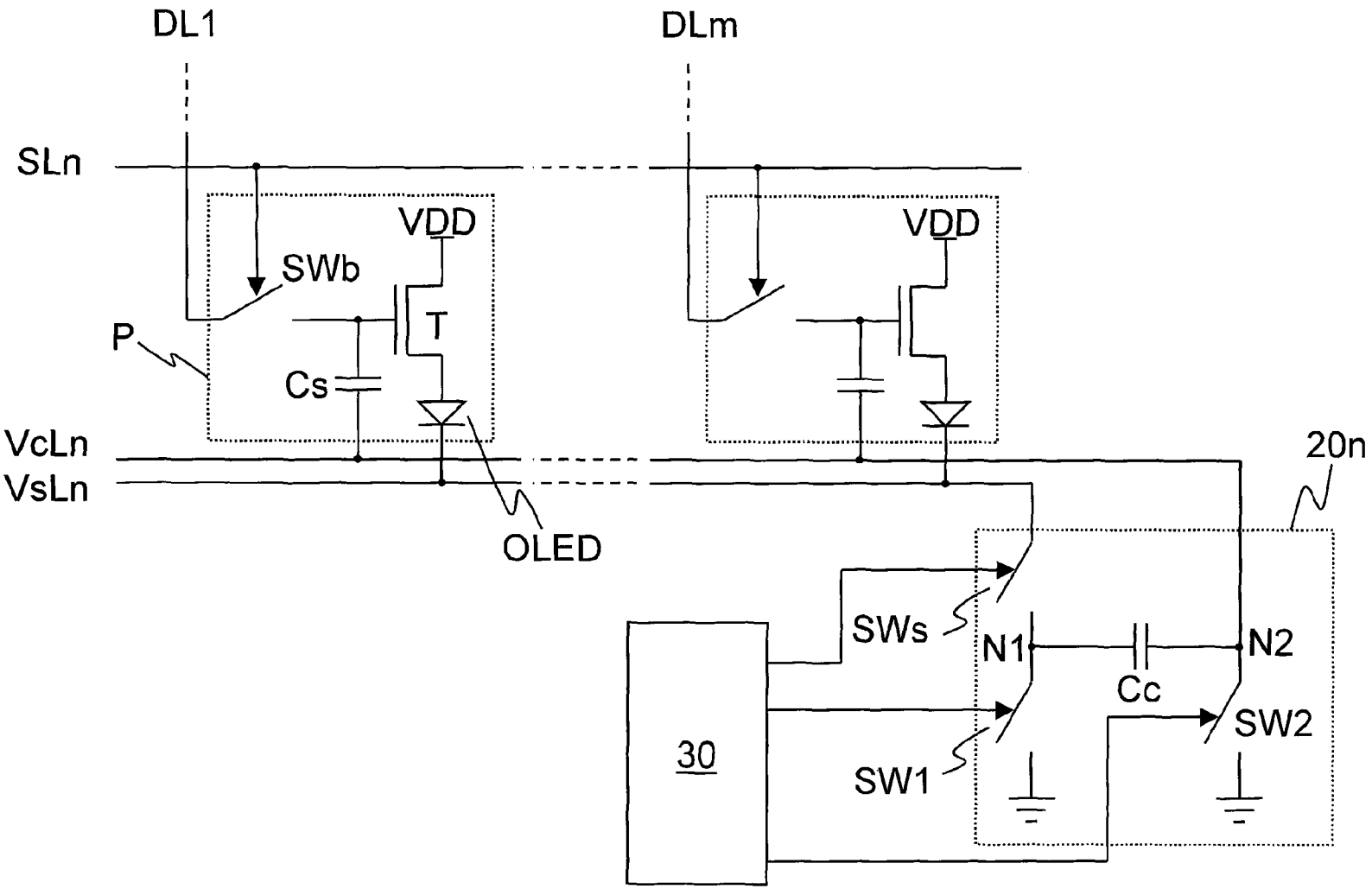
FIG. 8A is a schematic view illustrating fifth embodiment of the partial circuit architecture of the OLED panel according to the invention.
Figure 8B:
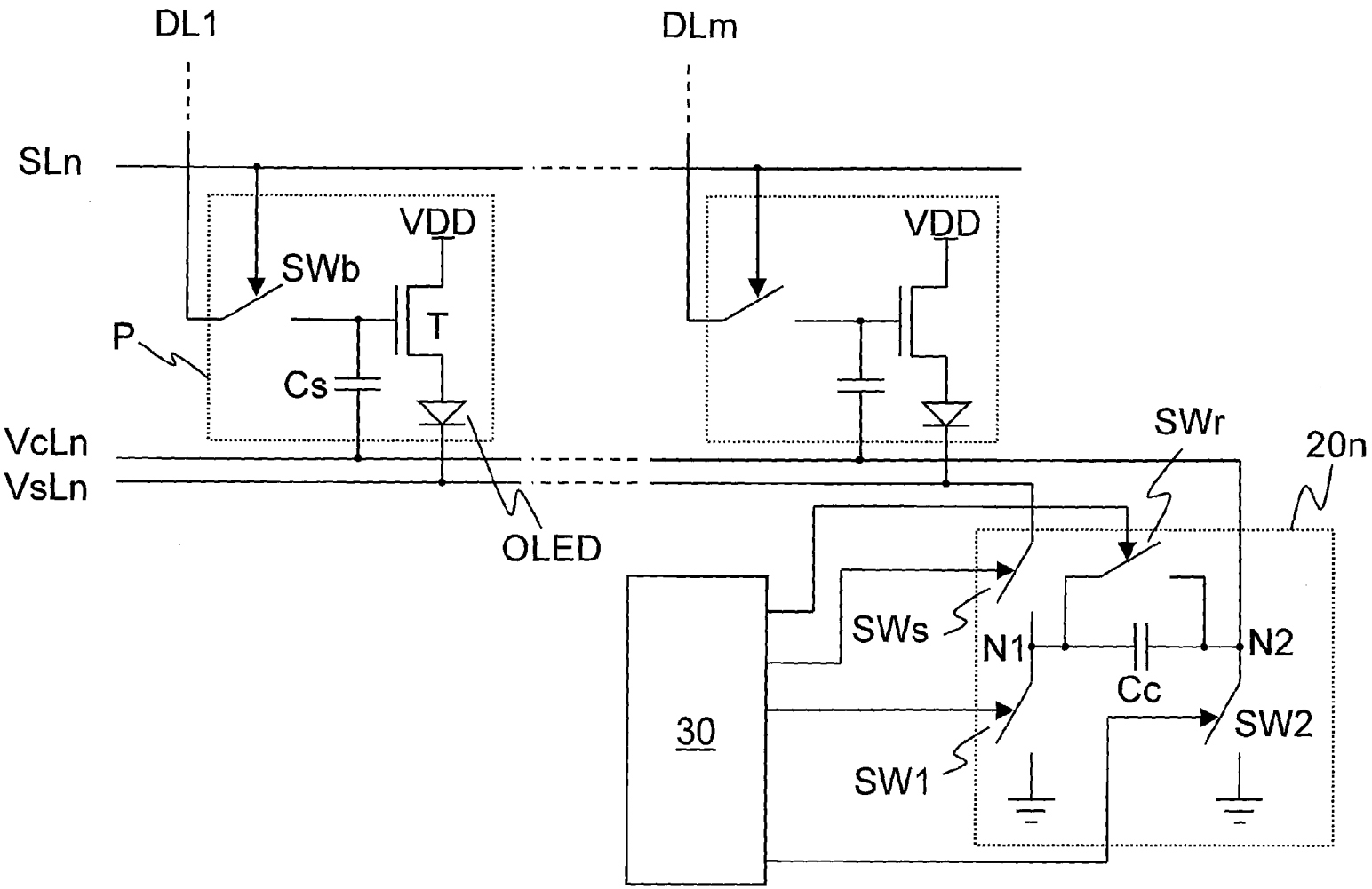
FIG. 8B is a schematic view illustrating sixth embodiment of the partial circuit architecture of the OLED panel according to the invention.
Figure 8C:
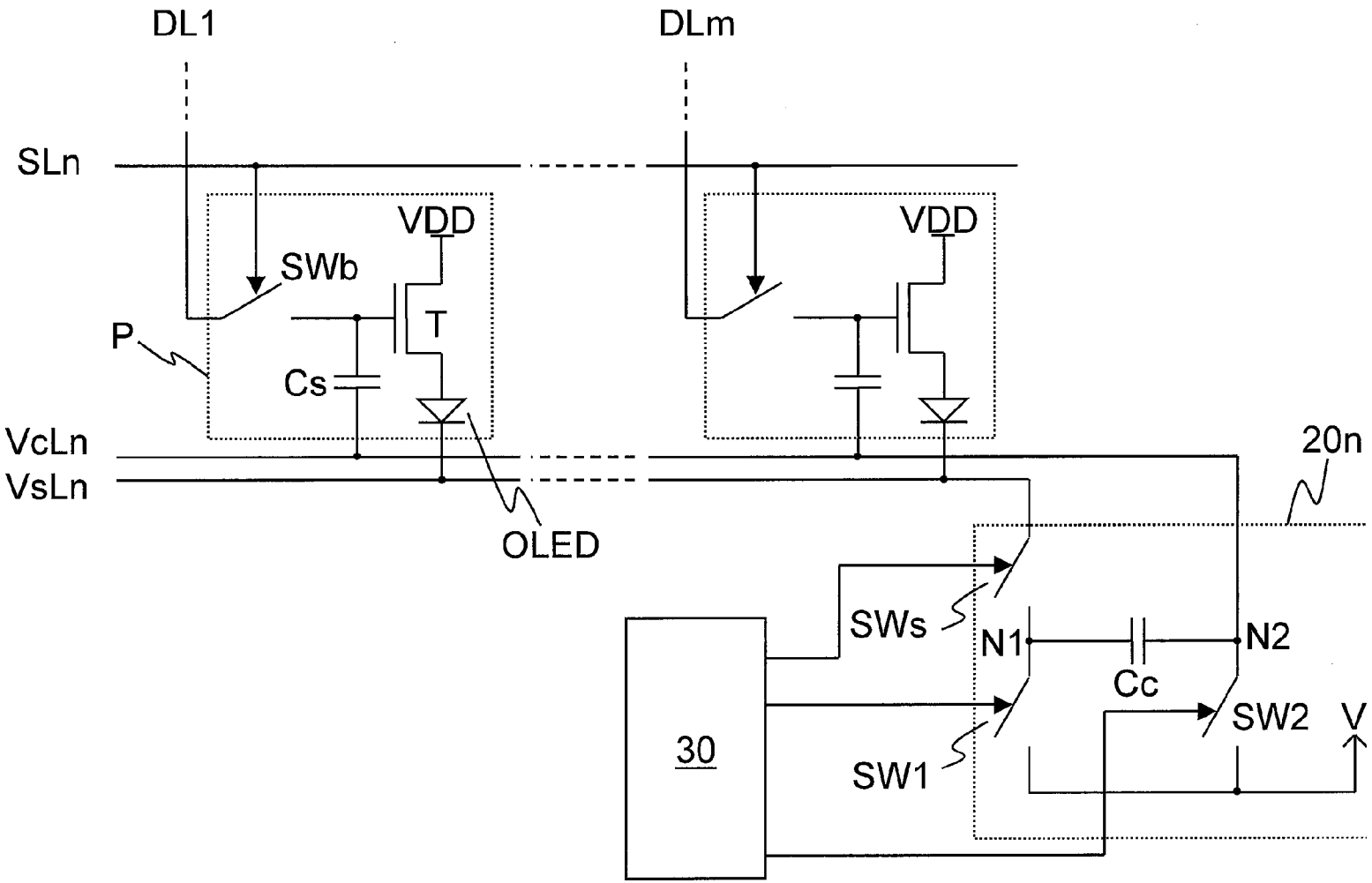
FIG. 8C is a schematic view illustrating seventh embodiment of the partial circuit architecture of the OLED panel according to the invention.
Figure 8D:
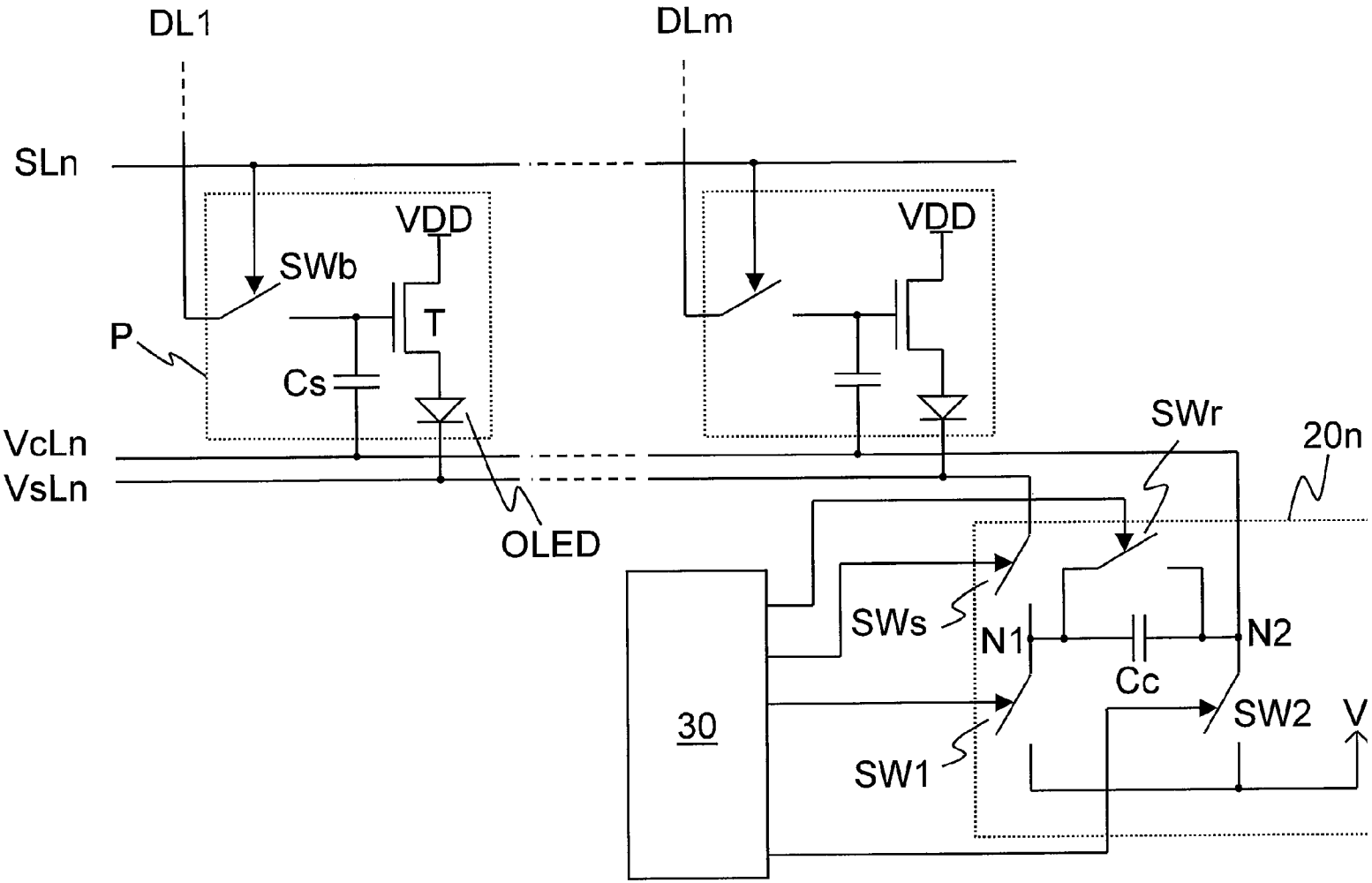
FIG. 8D is a schematic view illustrating eighth embodiment of the partial circuit architecture of the OLED panel according to the invention.

In another embodiment, the first end N1 of the compensation capacitor Cc also can be connected to a stable voltage V when the first switch SW1 is on, and the second end N2 of the compensation capacitor Cc also can be connected to the stable voltage V when the second switch SW2 is on, as shown in FIG. 6 and FIG. 7. The voltage source VDD and the stable voltage V can be from the same or different voltage source.

A switch controller 30 can be used for controlling the sampling switch SWs, the first switch SW1 and the second switch SW2, referring to FIG. 8A, FIG. 8B, FIG. 8C and FIG. 8D.

Figure 9:
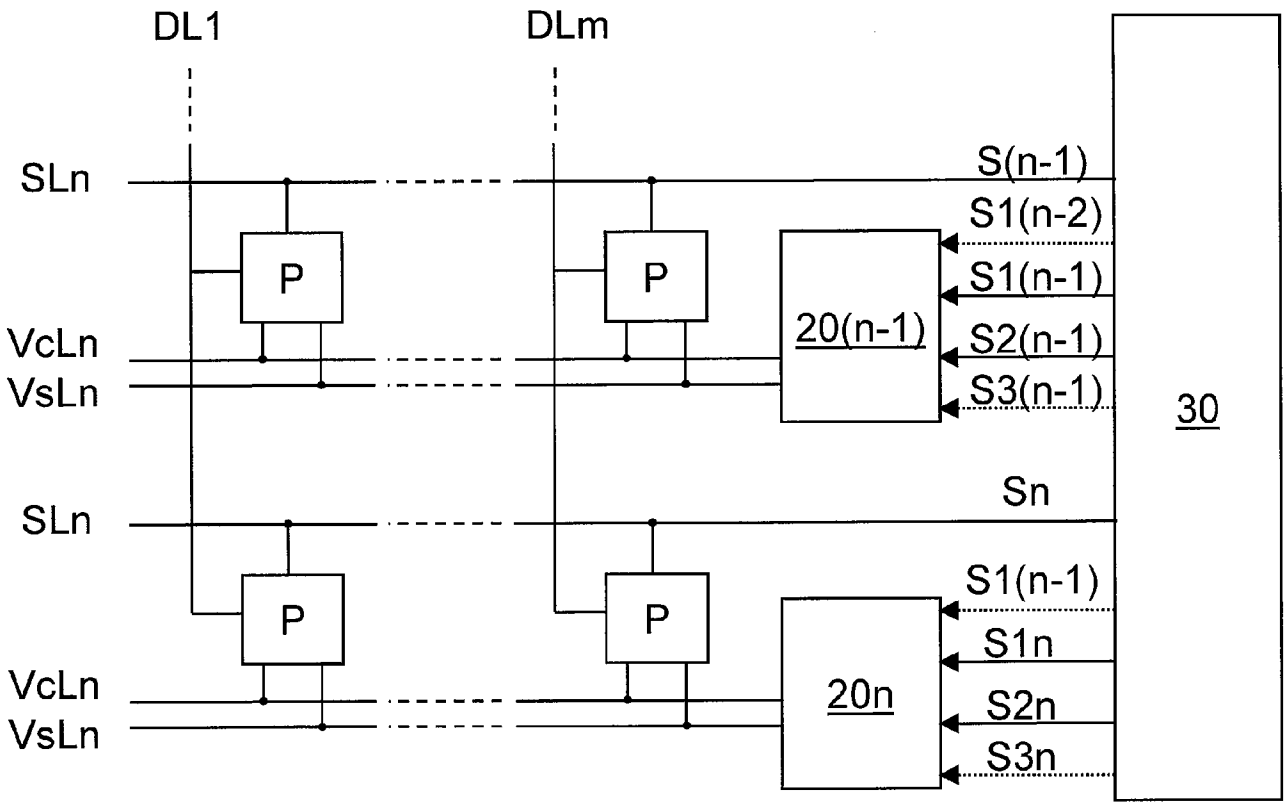
FIG. 9 is a schematic view illustrating ninth embodiment of the partial circuit architecture of the OLED panel according to the invention.

Referring to FIG. 9, the switch controller 30 can generate several control signals S1(*n*-2), S1(*n*-1), S2(*n*-1), S3(*n*-1), S1(*n*-1), S1*n*, S2*n* and S3*n* in response to the scan signals S(n-1) and Sn. The switch controller can generate the control signals using at least an inverter and/or at least a shifter according to the types of the reset switches, the sampling switches, the first switches and the second switches.

Figure 10B:
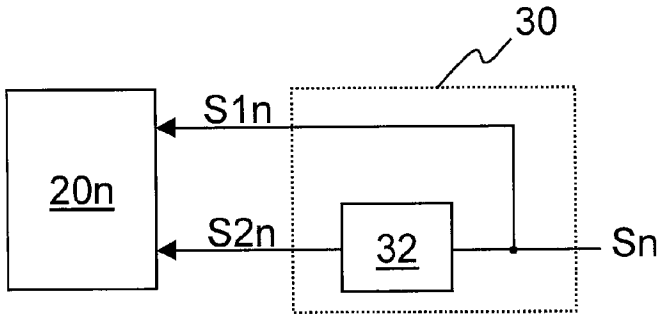
FIG. 10B is a schematic view illustrating the second embodiment of the switch controller in the OLED panel according to the invention.
Figure 10A:
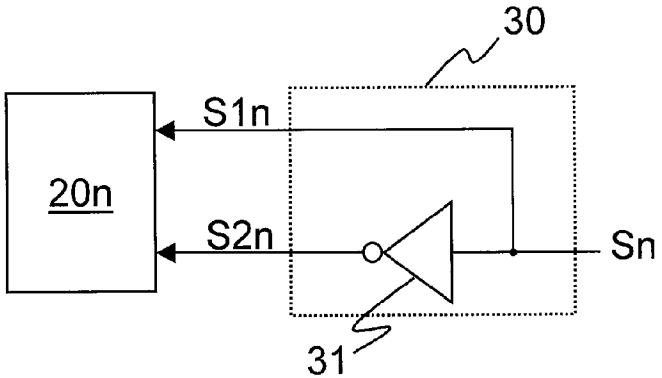
FIG. 10A is a schematic view illustrating the first embodiment of a switch controller in the OLED panel according to the invention.
Figure 10C:
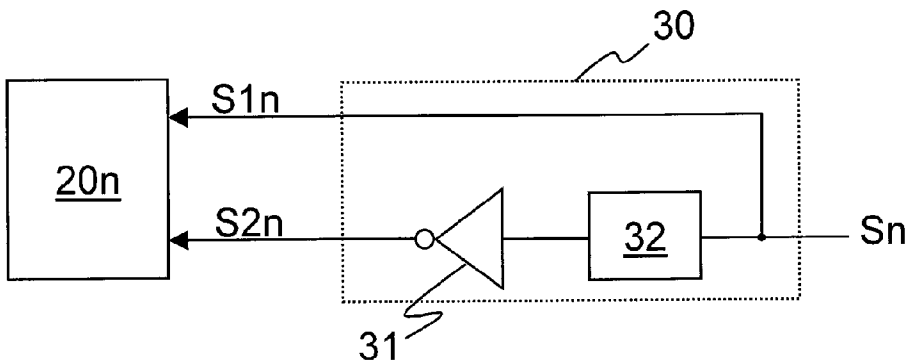
FIG. 10C is a schematic view illustrating the third embodiment of the switch controller in the OLED panel according to the invention.

As an example of generating two control signals for each compensation circuit, referring to FIG. 10A, in compensation circuit 20*n*, after the scan signal Sn into the switch controller 30, a inverter 31 inverts the scan signal Sn to generate two control signal S1*n* and S2*n*, so as to control the sampling switch, the first switch and the second switch in the compensation circuit 20*n*. Moreover, the control signal S2*n* can also be generated by a shifter 32 or combination of the inverter 31 and the shifter 32, with reference to FIG. 10B and FIG. 10C.

Figure 11B:
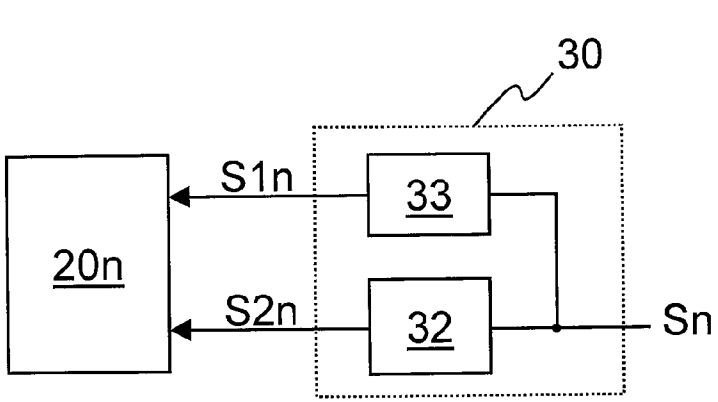
FIG. 11B is a schematic view illustrating the fifth embodiment of the switch controller in the OLED panel according to the invention.
Figure 11A:
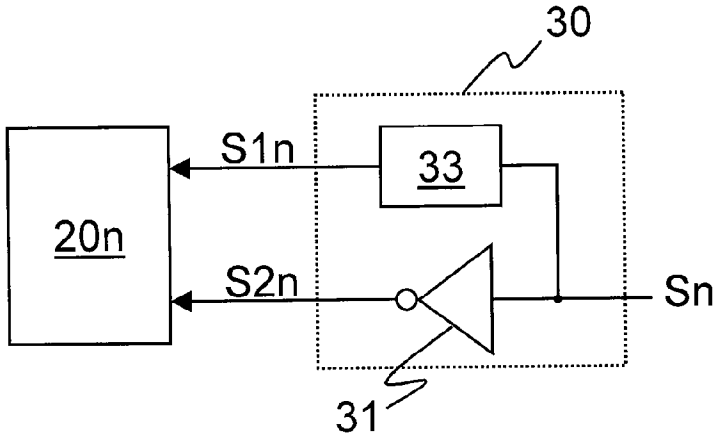
FIG. 11A is a schematic view illustrating the fourth embodiment of the switch controller in the OLED panel according to the invention.
Figure 11C:
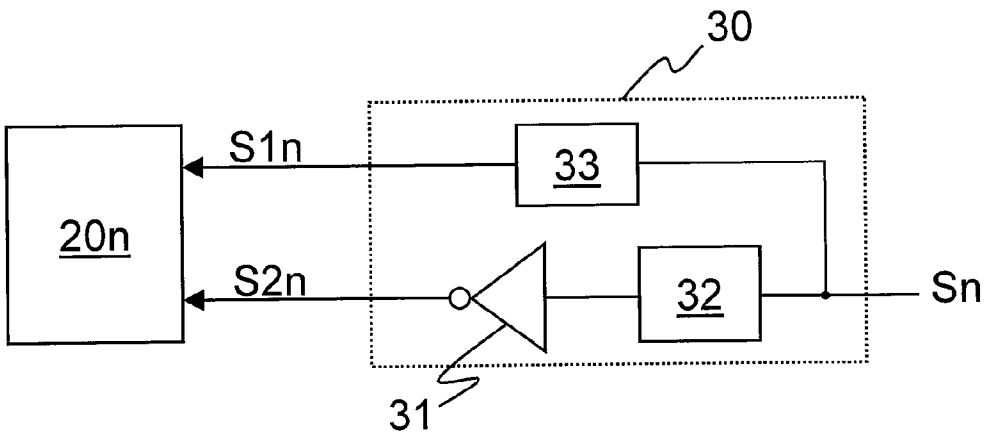
FIG. 11C is a schematic view illustrating the sixth embodiment of the switch controller in the OLED panel according to the invention.

In the switch controller 30, at least a buffer 33 is used for buffering the control signal S1*n* and S2*n* to be synchronize, referring to FIG. 11A, FIG. 11B and FIG. C.

Figure 12A:
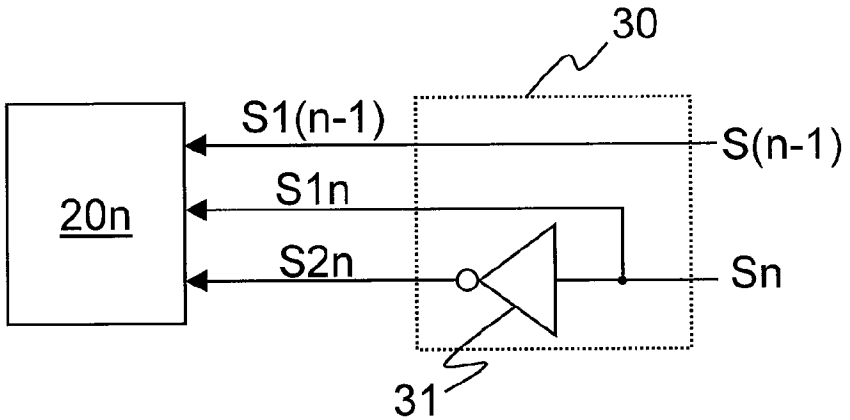
FIG. 12A is a schematic view illustrating the seventh embodiment of the switch controller in the OLED panel according to the invention.
Figure 12B:
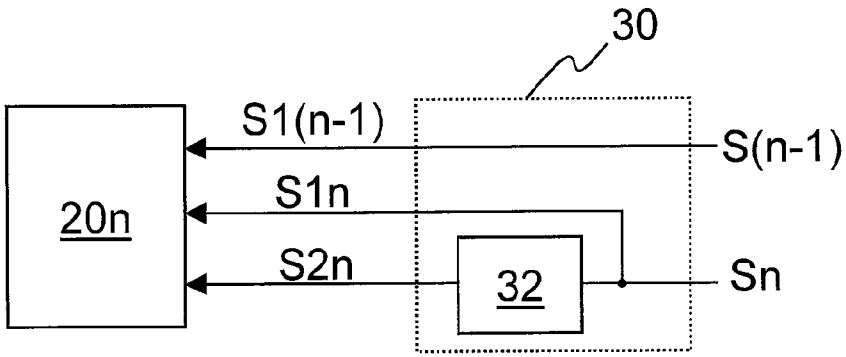
FIG. 12B is a schematic view illustrating the eighth embodiment of the switch controller in the OLED panel according to the invention.
Figure 12C:
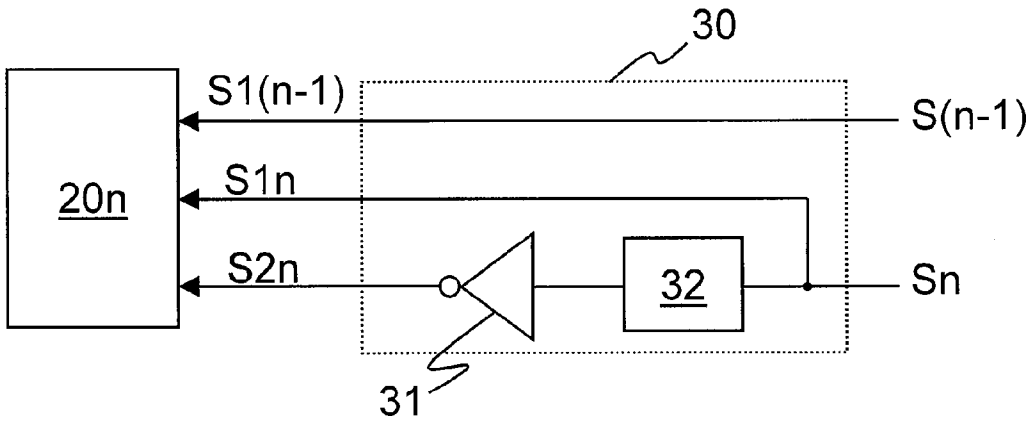
FIG. 12C is a schematic view illustrating the ninth embodiment of the switch controller in the OLED panel according to the invention.

As an example of generating three control signals for each compensation circuit, in compensation circuit 20*n*, the switch controller 30 can generate the control signal S2*n* through the inverter 31, the shifter 32 or the combination thereof according to the scan signals Sn and S(n-1), and transmit the control signal S1(*n*-1), S1*n* and S2*n*, referring to FIG. 12A, FIG. 12B and FIG. 12C.

Figure 13A:
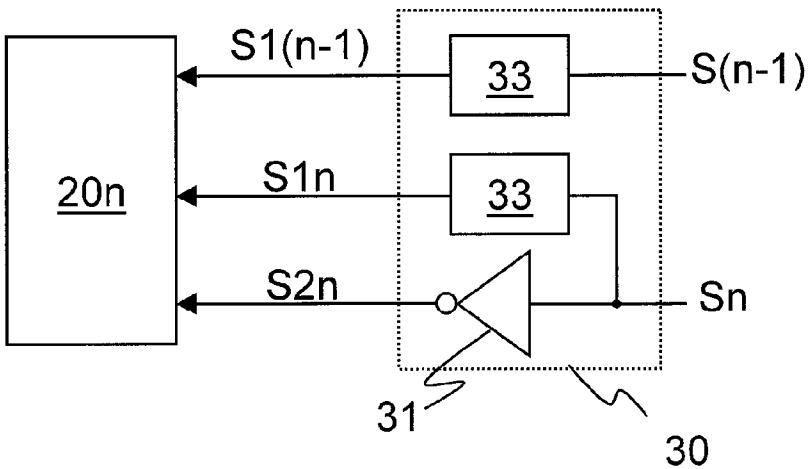
FIG. 13A is a schematic view illustrating the tenth embodiment of the switch controller in the OLED panel according to the invention.
Figure 13B:
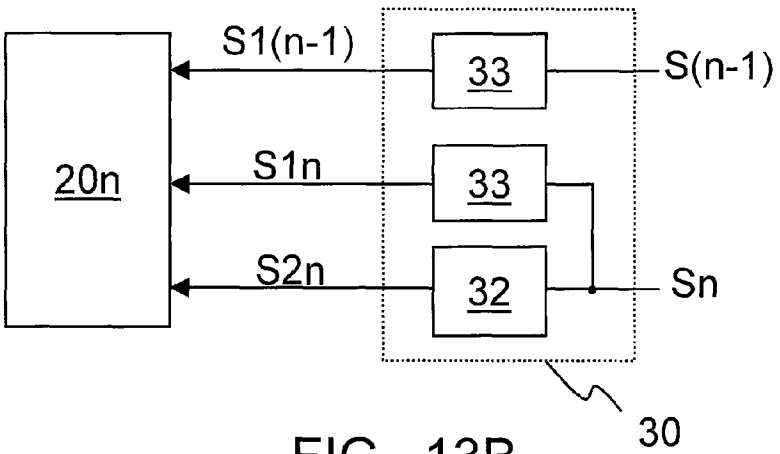
FIG. 13B is a schematic view illustrating the eleventh another embodiment of the switch controller in the OLED panel according to the invention.
Figure 13C:
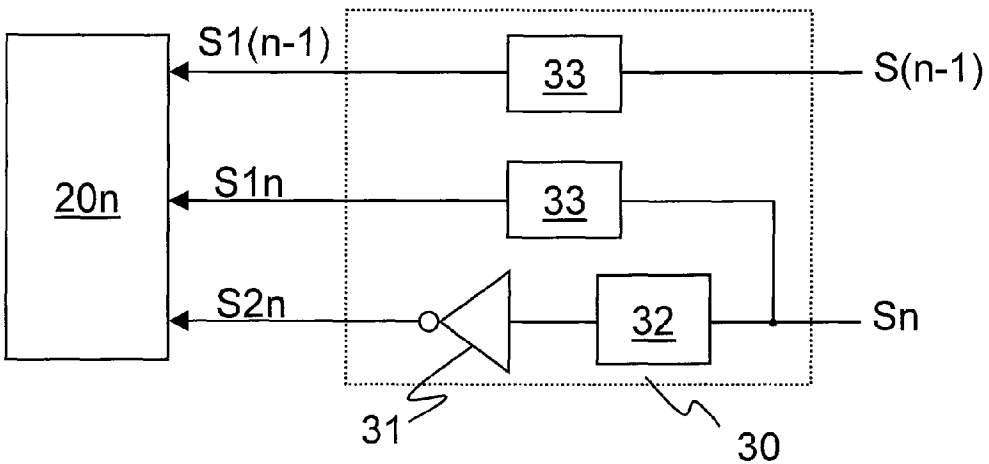
FIG. 13C is a schematic view illustrating the twelfth another embodiment of the switch controller in the OLED panel according to the invention.

In this embodiment, the switch controller 30 can synchronize the control signals S1(*n*-1), S1*n* and S2*n* to be transmitted using the buffer 33, referring to FIG. 13A, FIG. 13B and FIG. 13C.

In other words, the switch controller can invert the scan signal using the inverter, shift the phase of the scan signal using the buffer, and/or buffer the scan signal or the control signal to be transmitted using the buffer, to generate the control signals for controlling the compensation circuit.

In the compensation circuit, the reset switch, the sampling switch, the first switch and the second switch can be transistors, such as thin film transistors.

Figure 14A:
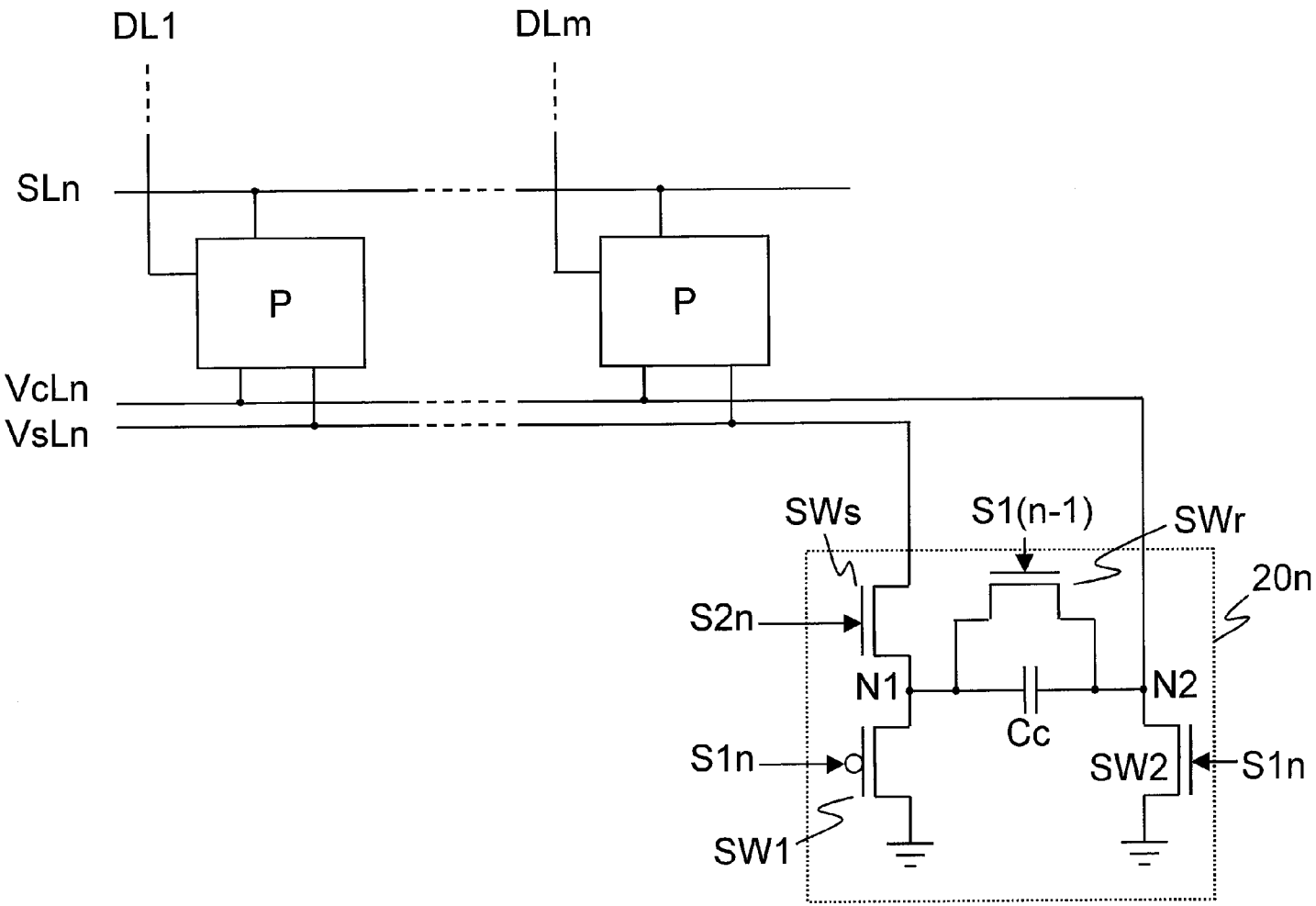
FIG. 14A is a schematic view illustrating the first embodiment of the compensation circuit in the OLED panel according to the invention.
Figure 14B:
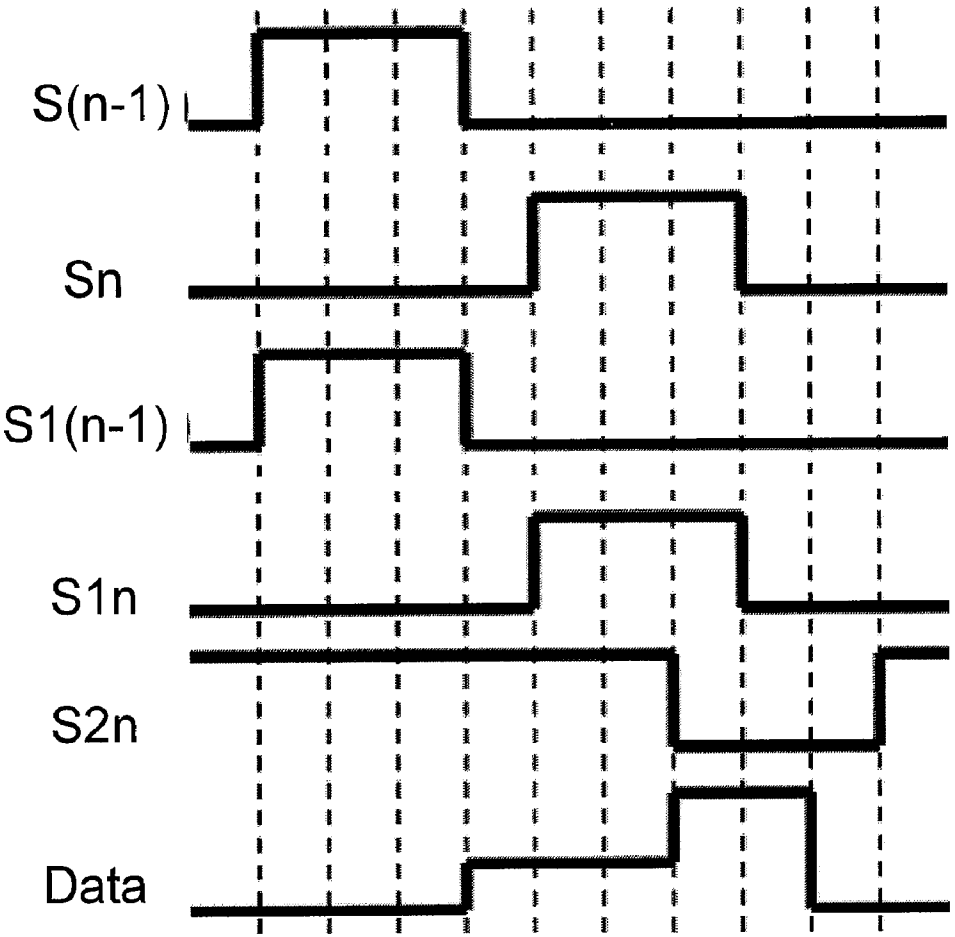
FIG. 14B shows waveform of each signal in the switch controller shown in the FIG. 14A.

Referring to FIG. 14A, suppose that the first switch SW1 is P-channel transistor, and the reset switch SWr, the sampling switch SWs and the second switch SW2 are N-channel transistors. In this embodiment, the compensation circuit 20*n* is controlled by three control signals S1(*n*-1), S1*n* and S2*n*. The waveform of each signal is shown in FIG. 14B, where Data represents the data signal transmitted through the data lines DL1 to DLm, Sn represents the scan signal transmitted through the n-th scan line SLn, and S(n-1) represents the scan signal transmitted through the (n-1)th scan line SL(n-1) (not shown). The control signal S2*n* is generated through shifting and inverting the scan signal Sn.

Figure 15A:
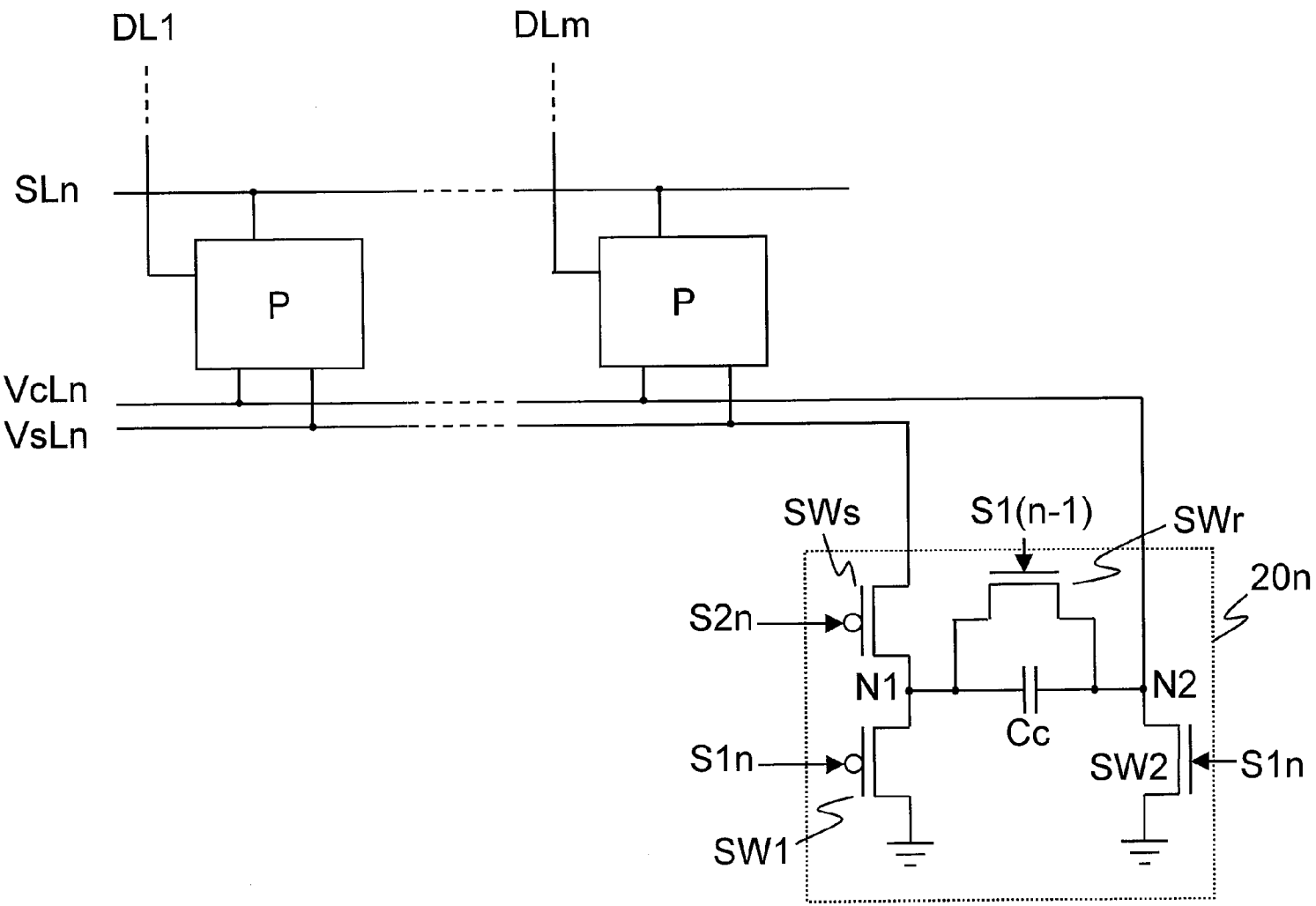
FIG. 15A is a schematic view illustrating the second embodiment of the compensation circuit in the OLED panel according to the invention.
Figure 15B:
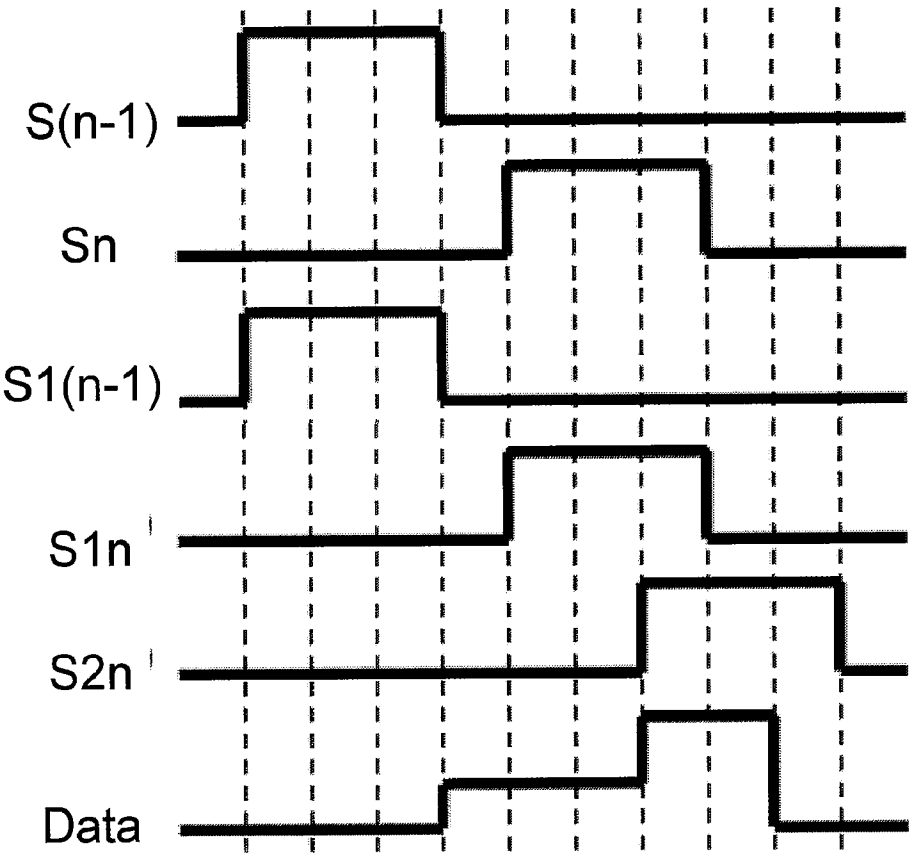
FIG. 15B shows waveform of each signal in the switch controller shown in the FIG. 15A.

Referring to FIG. 15A, suppose that the first switch SW1 and the second switch SW2 are P-channel transistors, and the reset switch SWr and the sampling switch SWs are N-channel transistors. In this embodiment, the compensation circuit 20*n* is controlled by three control signals S1(*n*-1), S1*n* and S2*n*. The waveform of each signal is shown in FIG. 15B, where Data represents the data signal transmitted through the data lines DL1 to DLm, Sn represents the scan signal transmitted through the n-th scan line SLn, and S(n-1) represents the scan signal transmitted through the (n-1)th scan line SL(n-1) (not shown). The control signal S2*n* is generated through shifting the scan signal Sn.

Figure 16A:
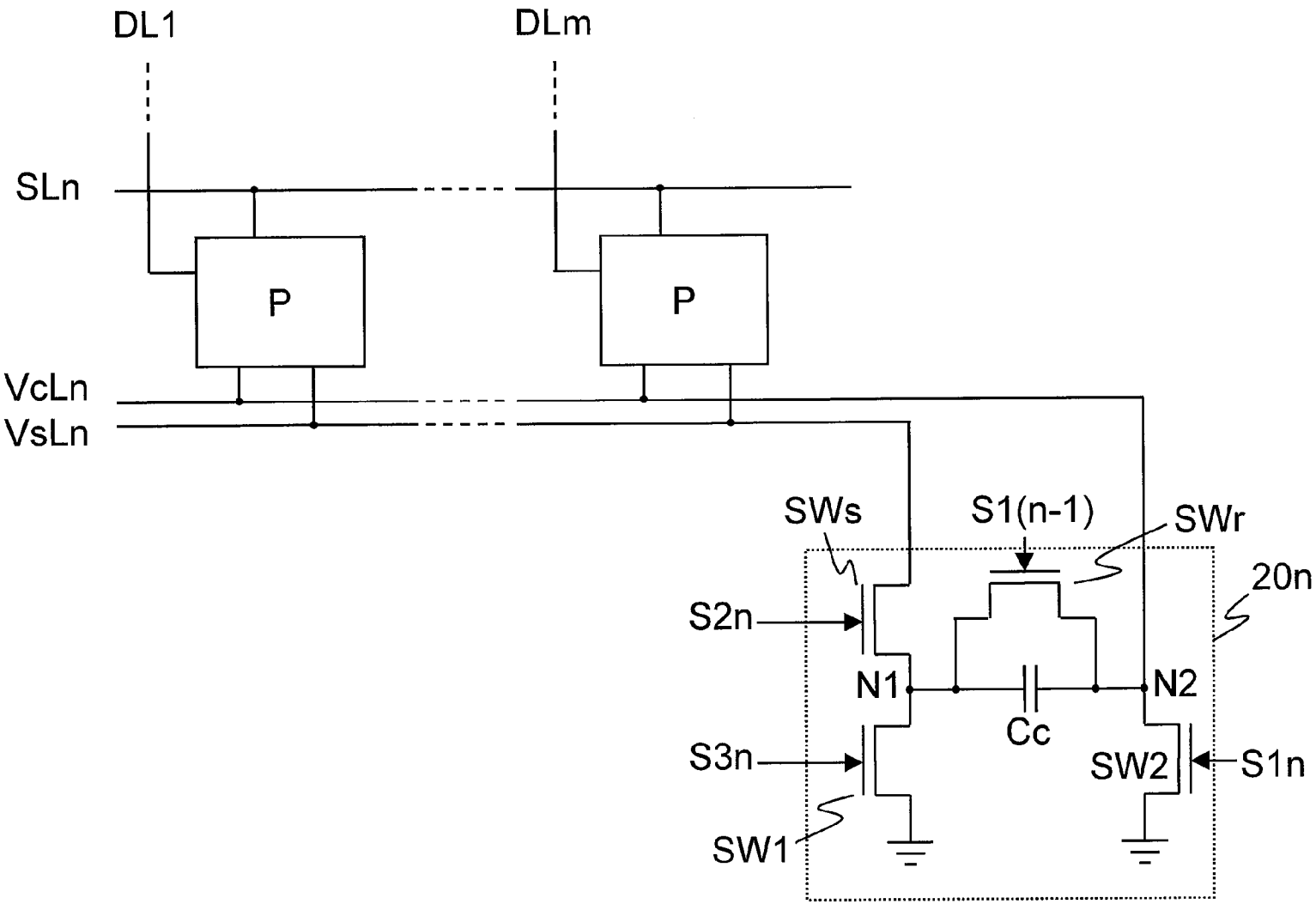
FIG. 16A is a schematic view illustrating the third embodiment of the compensation circuit in the OLED panel according to the invention.
Figure 16B:
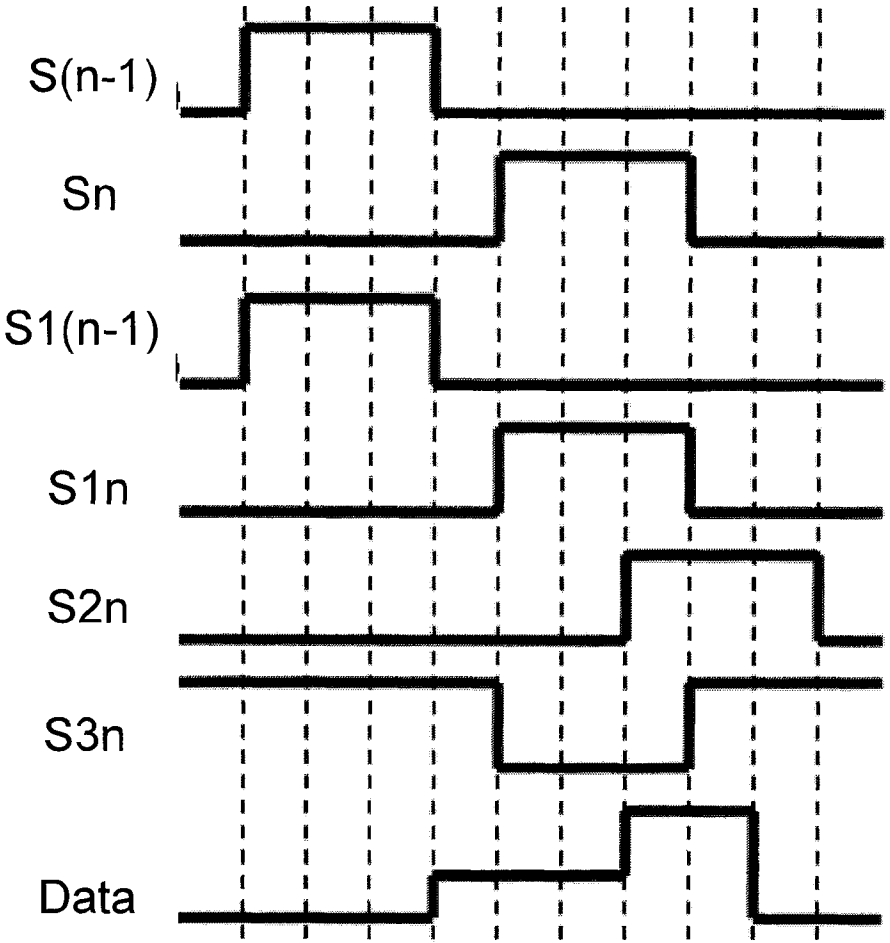
FIG. 16B shows waveform of each signal in the switch controller shown in the FIG. 16A.

Referring to FIG. 16A, suppose that the reset switch SWr, the sampling switch SWs, the first switch SW1 and the second switch SW2 are N-channel transistors. In this embodiment, the compensation circuit 20*n* is controlled by four control signals S1(*n*-1), S1*n*, S2*n* and S3*n*. The waveform of each signal is shown in FIG. 16B, where Data represents the data signal transmitted through the data lines DL1 to DLm, Sn represents the scan signal transmitted through the n-th scan line SLn, and S(n-1) represents the scan signal transmitted through the (n-1)th scan line SL(n-1) (not shown). The control signal S2*n* is generated through shifting and inverting the scan signal Sn, and the control signal S3*n* is generated through inverting the scan signal Sn.

Figure 17:
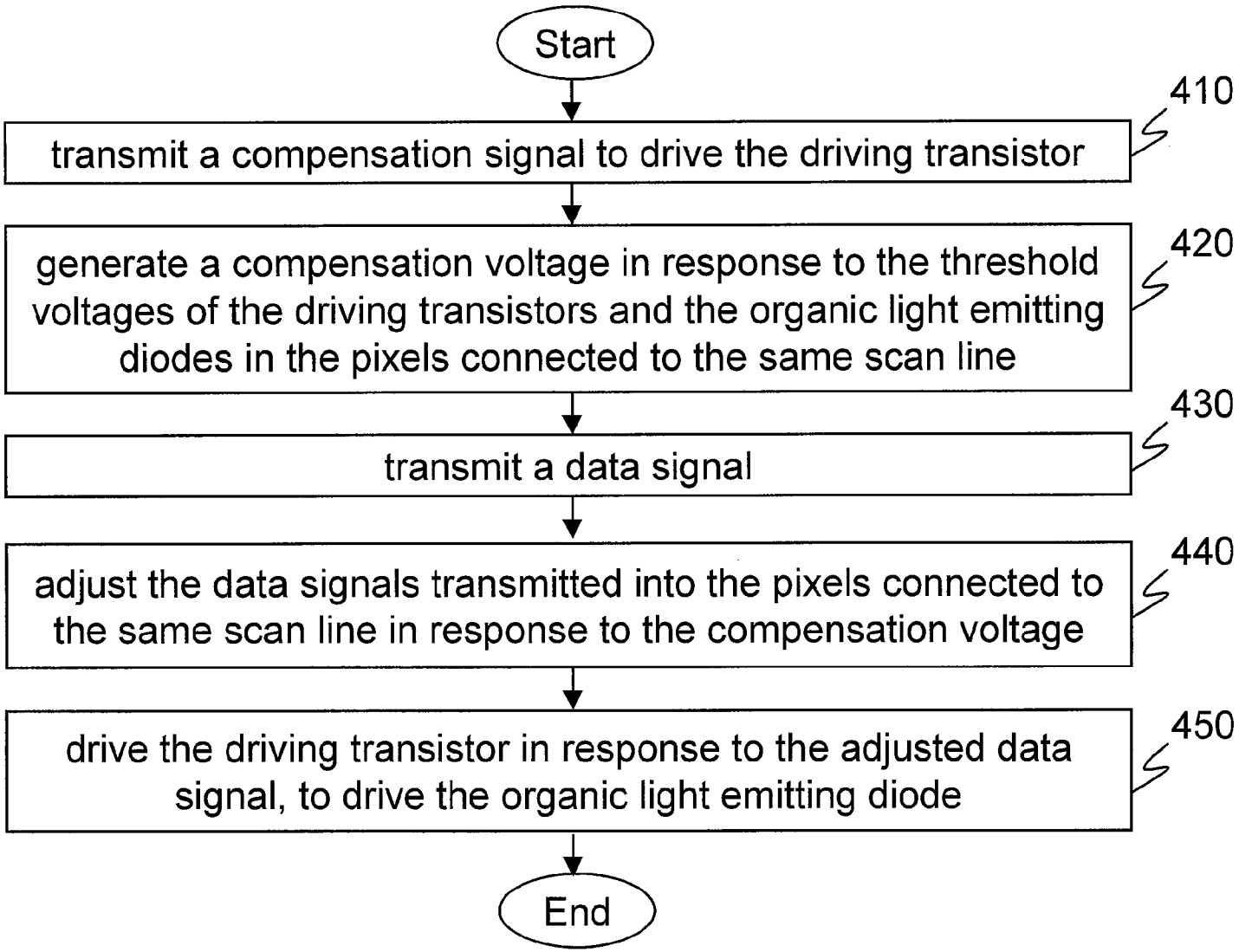
FIG. 17 is a flow chart of a driving method of the OLED panel according to the first embodiment of the invention.

Refer to FIG. 17, which shows a driving method of the OLED panel according to the invention. The OLED panel has several pixels, each which is defined by two neighboring data lines and two neighboring scan lines crossing the two neighboring data lines, is connected to a data line and a scan line and comprises an organic light emitting diode, a driving transistor and a bias switch. The driving method comprises the following steps. First, a compensation signal is transmitted from the data line via the bias switch, to drive the driving transistor, such that the current flows through the organic light emitting diode (step 410). A compensation voltage is generated in response to threshold voltages of the driving transistors and the organic light emitting diodes in the pixels connected to the same scan line (step 420). A data signal is transmitted through the data line via the bias switch (step 430). The data signals, transmitted into the pixels which are connected to the same scan line, are adjusted in response to the compensation voltage (step 440). And, the driving transistor is drove in response to the adjusted data signal, to drive the organic light emitting diode (step 450).

Figure 18:
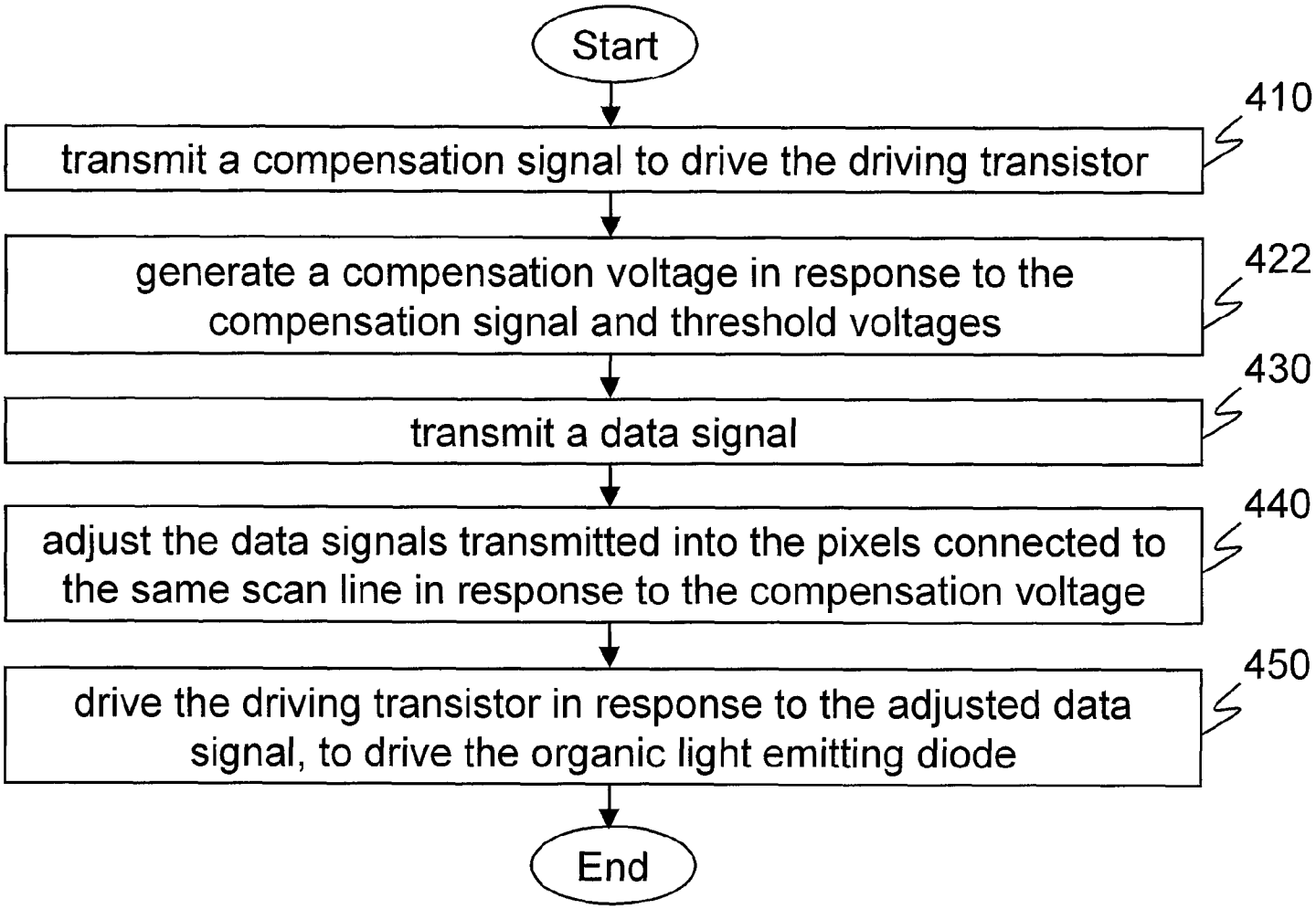
FIG. 18 is a flow chart of a driving method of the OLED panel according to the second embodiment of the invention.

Further, the compensation voltage can be generated in response to the compensation signal and the threshold voltages of the driving transistors and the organic light emitting diodes in the pixels connected to the same scan line (step 422), as shown in FIG. 18.

Figure 19:
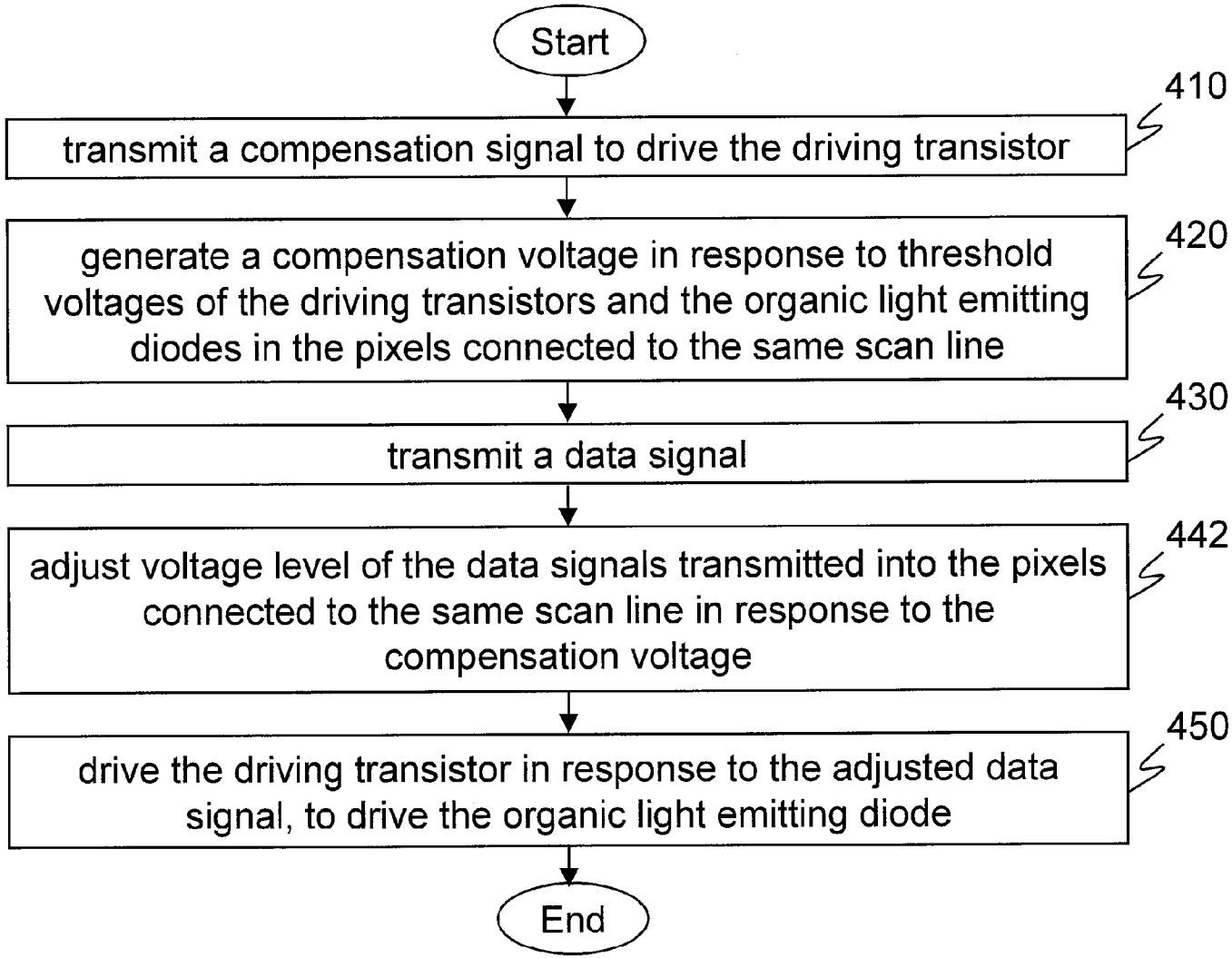
FIG. 19 is a flow chart of a driving method of the OLED panel according to the third embodiment of the invention.

Furthermore, the voltage level of each of the data signals, transmitted into the pixels connected to the same scan line, is adjusted in response to the compensation voltage (step 442), as shown in FIG. 19.

Figure 20:
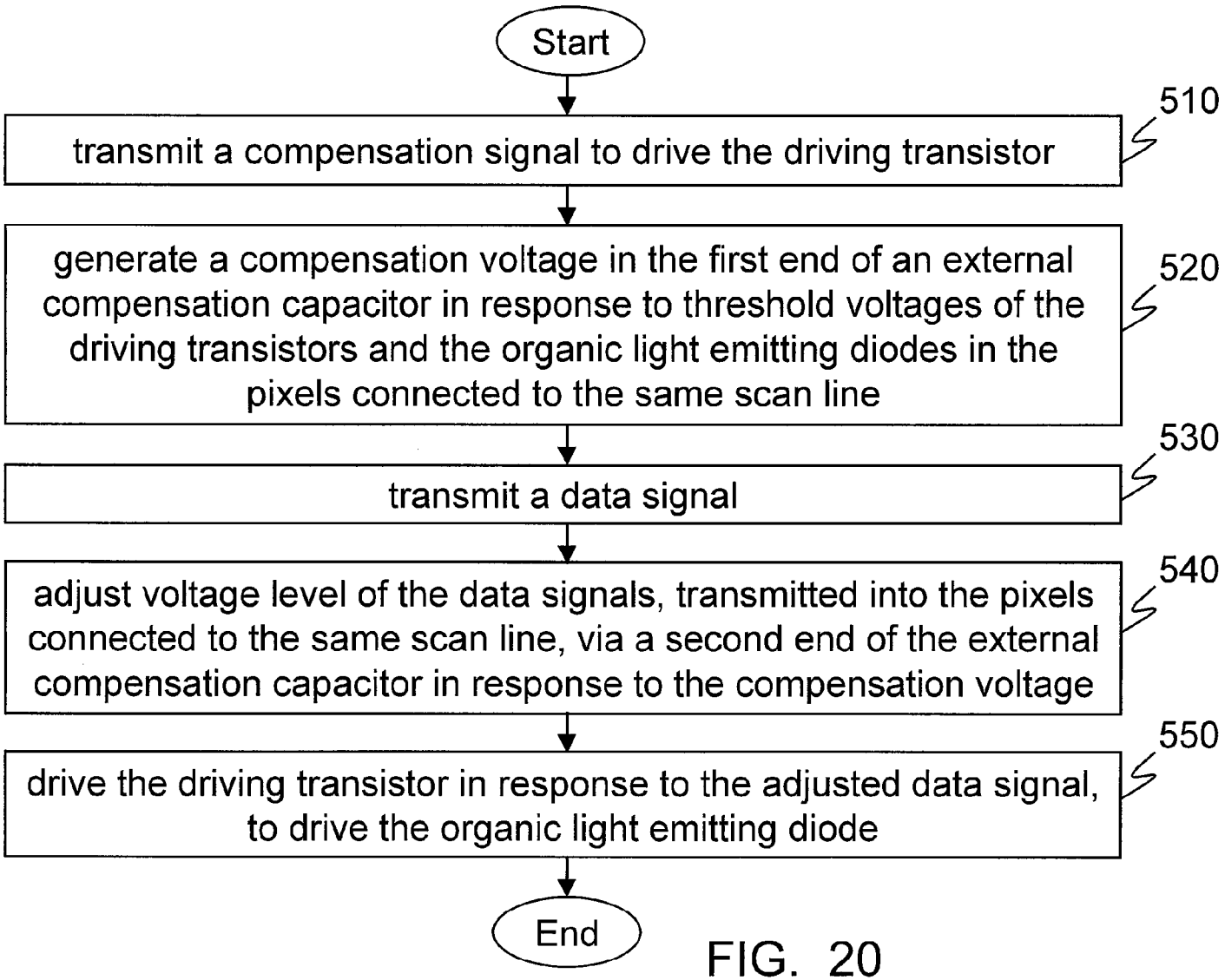
FIG. 20 is a flow chart of a driving method of the OLED panel according to the fourth embodiment of the invention.

In another embodiment, FIG. 20 shows the driving method of the OLED panel according to the invention. The OLED panel has several pixels, each which is defined by two neighboring data lines and two neighboring scan lines crossing the two neighboring data lines, is connected to a data line and a scan line and comprises an organic light emitting diode, a driving transistor and a bias switch. The driving method comprises the following steps. First, a compensation signal is transmitted from the data line via the bias switch, to drive the driving transistor, such that the current flows through the organic light emitting diode (step 510). A compensation voltage in the first end of an external compensation capacitor is generated in response to threshold voltages of the driving transistors and the organic light emitting diodes in the pixels connected to the same scan lines (step 520). A data signal is transmitted through the data line via the bias switch (step 530). Each of the data signals, which are transmitted into the pixels connected to the same scan lines, is adjusted via a second end of the external compensation capacitor in response to the compensation voltage (step 540). Then, the driving transistor is drove in response to the adjusted data signal, to drive the organic light emitting diode (step 550).

Figure 21:
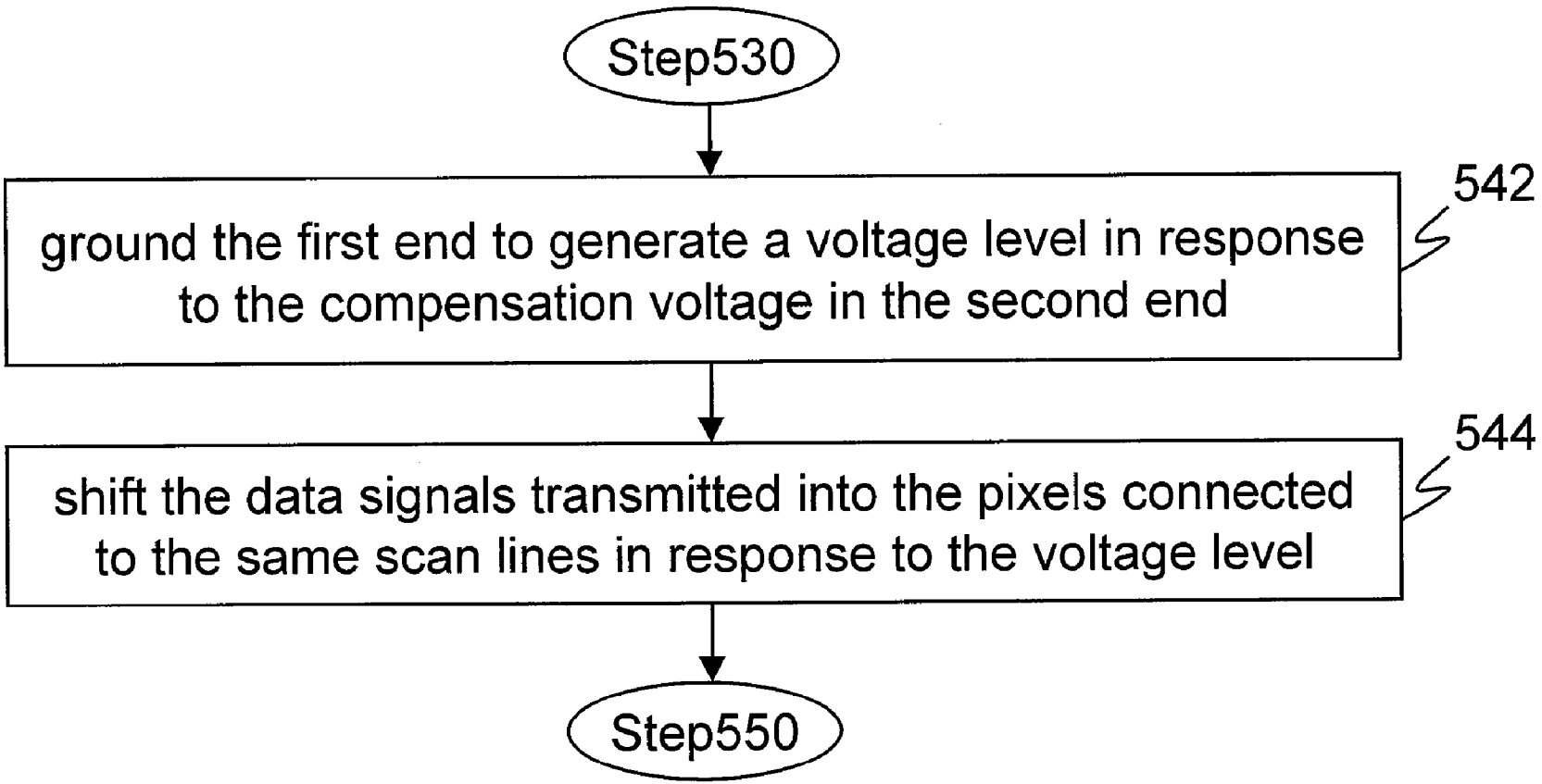
FIG. 21 is a partial flow chart of a driving method of the OLED panel according to the fifth embodiment of the invention.

Referring to FIG. 21, in the step 540, the following steps are included. The first end is grounded to generate a voltage level in response to the compensation voltage in the second end (step 542). Then, each of the data signals, transmitted into the pixels connected to the same scan lines, are shifted in response to the voltage level (step 544).

Figure 22:
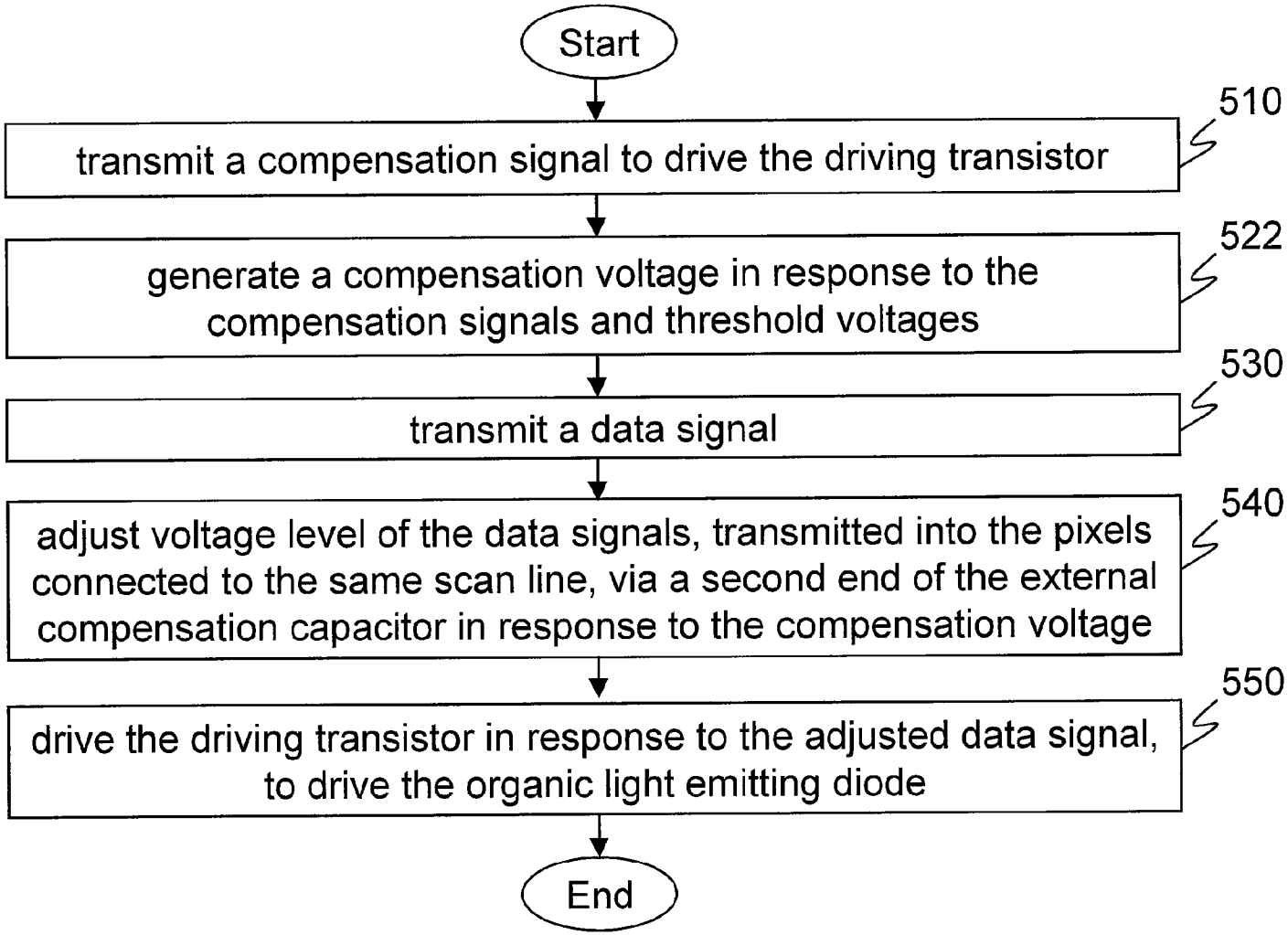
FIG. 22 is a flow chart of a driving method of the OLED panel according to the sixth embodiment of the invention.

Further, the compensation voltage can be generated in response to the compensation signal and the threshold voltages of the driving transistors and the organic light emitting diodes in the pixels connected to the same scan line (step 522), as shown in FIG. 22.

Figure 23:
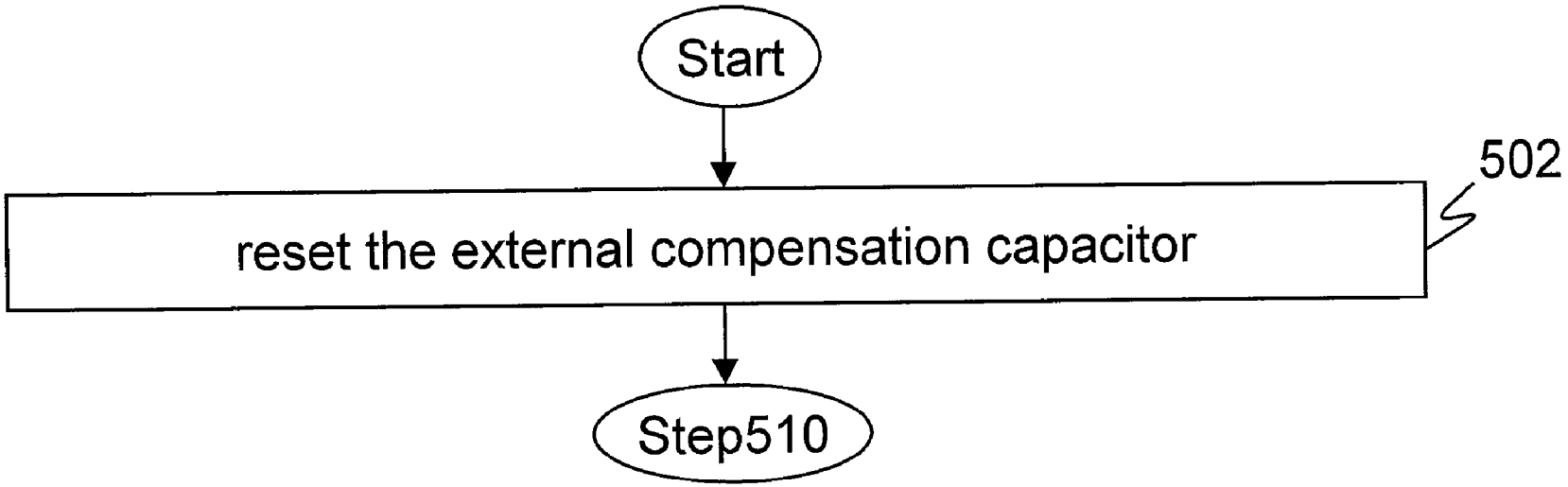
FIG. 23 is a partial flow chart of a driving method of the OLED panel according to the seventh embodiment of the invention.

The driving method further comprises the following steps, as shown in FIG. 23. The external compensation capacitor is reset (step 502), to substantially completely discharge the external compensation capacitor before driving.

The preferred embodiments disclosed are only for illustrating the present invention, and not for giving any limitation to the scope of the present invention. It will be apparent to those skilled in this art that various modifications or changes can be made to the present invention without departing from the spirit and scope of this invention. Accordingly, all such modifications and changes also fall within the scope of protection of the appended claims

What is claimed is:

1. An organic light-emitting diode (OLED) panel, comprising:

a plurality of data lines, each data line selectively transmitting a compensation signal and a data signal;

a plurality of scan lines, each scan line transmitting a scan signal, wherein two neighboring data lines and two neighboring scan lines crossing the two neighboring data lines, which define a plurality of pixels, and each pixel comprises:

an organic light emitting diode;

a driving transistor, having a control terminal, for controlling an amount of current passing through the organic light emitting diode; and a bias switch electrically connected to the data line and the control terminal of the driving transistor in response to the scan signal;

a plurality of sampling voltage lines electrically connected to the pixels connecting to the same scan line, each sampling voltage line transmitting a compensation voltage in response to the compensation signals and threshold voltages of the driving transistors and the organic light emitting diodes; and a plurality of compensation voltage lines electrically connected to the pixels connecting to the same scan line, each compensation voltage line adjusting data signals in response to the compensation voltage.

2. The OLED panel of claim 1 further comprising:

a plurality of compensation circuits, each compensation circuit comprising:

a compensation capacitor having a first end and a second end which is connected to the compensation voltage line;

a sampling switch connected between the first end and the sampling voltage line connected to the same pixels as the compensation voltage line connected to the compensation capacitor;

a first switch connected between the first end and one of ground and voltage source; and a second switch connected between the second end and one of the ground and the voltage source.

3. The OLED panel of claim 2, wherein when the data line transmits the compensation signal, the sampling switch and the second switch are on and the first switch is off.

4. The OLED panel of claim 2, wherein when the data line transmits the data signal, the second switch is on and the sampling switch and the first switch are off.

5. The OLED panel of claim 2, wherein the first switch is on and the sampling switch and the second switch are off before the organic light emitting diode is on.

6. The OLED panel of claim 2, wherein when the data line transmits the data signal, the first switch is on and the sampling switch and the second switch are off.

7. The OLED panel of claim 2, wherein the sampling switch and the first switch are on and the second switch is off when the organic light emitting diode is on.

8. The OLED panel of claim 2, wherein the sampling switch, the first switch and the second switch work in response to the scan signal.

9. The OLED panel of claim 2, wherein the sampling switch is connected to the corresponding scan line.

10. The OLED panel of claim 2, wherein the first switch is connected to the corresponding scan line.

11. The OLED panel of claim 2, wherein the second switch is connected to the corresponding scan line.

12. The OLED panel of claim 2, further comprising:

a switch controller for modulating the sampling switch, the first switch and the second switch.

13. The OLED panel of claim 12, wherein the switch controller is connected to the scan line, and for controlling the sampling switch, the first switch and the second switch according to the scan signal.

14. The OLED panel of claim 2, wherein each compensation circuit further comprising:

a shifter for shifting a phase of a signal transmitted into the compensation circuit.

15. The OLED panel of claim 14, wherein the signal transmitted into the compensation circuit is the scan signal.

16. The OLED panel of claim 2, wherein each compensation circuit further comprising:

an inverter for inverting the signal transmitted into the compensation circuit.

17. The OLED panel of claim 16, wherein the signal transmitted into the compensation circuit is the scan signal.

18. The OLED panel of claim 2, wherein each compensation circuit further comprising:

a buffer for buffering the signal transmitted into the compensation circuit.

19. The OLED panel of claim 18, wherein the signal transmitted into the compensation circuit is the scan signal.

20. The OLED panel of claim 2, wherein each compensation circuit further comprising:

a reset switch connected with two ends of the compensation capacitor.

21. The OLED panel of claim 20, wherein when a pre-stage of the scan line transmits the scan signal, the sampling switch, the first switch and the reset switch is on and the second switch is off, to reset the compensation capacitor.

22. The OLED panel of claim 20, wherein the reset switch has a control terminal and the control terminal of the reset switch is connected to the pre-stage of the scan.

23. The OLED panel of claim 1, wherein each pixel further comprising:

a storage capacitor connected between the compensation voltage line and a control terminal of the driving transistor.

24. A driving method of an OLED panel, the OLED panel comprising a plurality of pixels, each of which is defined by two data lines and two scan lines crossing the two data lines and comprises an organic light emitting diode, a driving transistor and a bias switch, the driving method comprising:

transmitting a compensation signal from the data line to drive the driving transistor;

generating a compensation voltage in a first end of an external compensation capacitor in response to threshold voltages of the driving transistors and the organic light emitting diodes in the pixels connected to the same scan lines;

transmitting a data signal through the data line via the bias switch;

adjusting each of the data signals, transmitted into the pixel connected to the same scan lines, via a second end of the external compensation capacitor in response to the compensation voltage; and driving the organic light emitting diode in response to the adjusted data signal.

25. The driving method of claim 24, wherein the step of generating the compensation voltage comprising: generating the compensation voltage in response to threshold voltages and the compensation signal.

26. The driving method of claim 24, wherein the step of adjusting each of the data signals comprising: adjusting a voltage level of each of the data signals, transmitted into each of the pixels connected to the same scan lines, in response to the compensation voltage.

27. A driving method of an OLED panel, the OLED panel comprising a plurality of pixels, each of which is defined by two neighboring data lines and two neighboring scan lines crossing the two neighboring data lines and comprises an organic light emitting diode, a driving transistor and a bias switch, the driving method comprising:

transmitting a compensation signal from the data line via the bias switch, to drive the driving transistor, such that current flows through the organic light emitting diode;

generating a compensation voltage in a first end of an external compensation capacitor in response to threshold voltages of the driving transistors and the organic light emitting diodes in the pixels connected to the same scan lines;

transmitting a data signal through the data line via the bias switch;

adjusting each of the data signals, transmitted into the pixel connected to the same scan lines, via a second end of the external compensation capacitor in response to the compensation voltage; and driving the driving transistor in response to the adjusted data signal, to drive the organic light emitting diode.

28. The driving method of claim 27, wherein the step of adjusting each of the data signals comprising:

grounding the first end to generate a voltage level in response to the compensation voltage in the second end; and shifting each of the data signals transmitted into the pixels connected to the same scan lines in response to the voltage level.

29. The driving method of claim 27, wherein the step of generating the compensation voltage comprising: generating the compensation voltage in response to threshold voltages and the compensation signals.

30. The driving method of claim 27, further comprising:

resetting the external compensation capacitor.

* * * * *